US007241000B2

(12) United States Patent
Hirota et al.

(10) Patent No.: US 7,241,000 B2
(45) Date of Patent: Jul. 10, 2007

(54) INKJET PRINTER

(75) Inventors: Atsushi Hirota, Nagoya (JP); Hidetoshi Watanabe, Tokoname (JP); Tadanobu Chikamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 264 days.

(21) Appl. No.: 11/008,604

(22) Filed: Dec. 10, 2004

(65) Prior Publication Data

US 2005/0157104 A1 Jul. 21, 2005

(30) Foreign Application Priority Data

Dec. 11, 2003 (JP) ..... 2003-413058

(51) Int. Cl.
*B41J 2/175* (2006.01)
*B41J 2/165* (2006.01)

(52) U.S. Cl. ..... 347/85; 347/35

(58) Field of Classification Search ..... 347/19, 347/20, 30, 35, 54, 65, 66, 85
See application file for complete search history.

(56) References Cited

U.S. PATENT DOCUMENTS 4,223,324 A * 9/1980 Yamamori et al. ..... 347/21
5,030,973 A * 7/1991 Nonoyama et al. ..... 347/93
5,777,649 A 7/1998 Otsuka et al.
6,007,193 A * 12/1999 Kashimura et al. ..... 347/92
6,190,008 B1 2/2001 Iwashita et al.
6,241,350 B1 6/2001 Otsuka et al.
6,582,069 B2 * 6/2003 Ohashi et al. ..... 347/94

FOREIGN PATENT DOCUMENTS

JP A 63-145039 6/1988
JP A-4-128046 4/1992
JP A 06-210872 8/1994
JP A 07-032612 2/1995
JP A 07-112530 5/1995
JP A-2003-94681 4/2003

* cited by examiner

*Primary Examiner*—Anh T. N. Vo
(74) *Attorney, Agent, or Firm*—Oliff & Berridge, PLC

(57) ABSTRACT

An inkjet printer has a reservoir unit including an ink supply port to which ink is supplied from the outside and an ink reservoir for storing the ink supplied from the ink supply port. Further, the inkjet printer has an air purging passage branched off from an area of an ink supply flow passage extending from the ink supply port to a manifold via the ink reservoir. The area is located downstream with respect to a filter; and an air purging valve capable of opening or closing the air purging passage. The air in the ink supply passage can be readily purged from the air purging passage.

9 Claims, 17 Drawing Sheets

INKJET PRINTER

BACKGROUND OF THE INVENTION

1. Field of the Invention

The present invention relates to an inkjet printer which effects printing by ejecting ink on a recording medium.

2. Description of the Related Art

An inkjet head of an inkjet printer ejects ink from a nozzle remaining in communication with respective pressure chambers, by distributing ink supplied from an ink supply port to the plurality of pressure chambers from a common ink chamber and selectively imparting pulse-like pressure to the respective pressure chambers. When air is trapped in an ink flow passage which is formed in an inkjet head and extends from the ink supply port to the nozzle the air adheres to an interior wall surface of the flow passage. As a result, a pressure wave imparted to ink by a pressure chamber fails to properly propagate through the flow passage, possibly deteriorating an ink-ejecting characteristic of the nozzle. Therefore, there is proposed an inkjet head having an air-discharging opening section branched off from an ink flow passage remaining in communication with the pressure chamber or an air purging passage such as a dummy nozzle (see, e.g., JP-A-7-112530 (FIG. 8) and Japanese Patent No. 2637957 (FIG. 1).

SUMMARY OF THE INVENTION

However, the air purging passage, such as the opening section or the dummy nozzle, is an individual ink flow passage which is branched to the individual pressure chambers and has a very small flow passage area. Purging air from such air purging passages branching off from the individual ink flow passages is not easy. Particularly, when a virgin inkjet head filled with air is filled with ink for the first time, purging of air from the air purging passages by supplying ink must be performed several times in order to completely purge air from the inside of the ink flow passages. In the course of such purging operation, a great quantity of ink is consumed.

It is an object of the present invention to provide an inkjet printer capable of readily discharging air from the inside of a flow passage.

According to one aspect of the invention, there is provided with a flow passage unit including a common ink chamber extending in one plane and a plurality of individual ink flow passages extending from the common ink chamber to nozzles by way of a pressure chamber; a reservoir unit which is fastened to the flow passage unit and includes an ink supply port by way of which ink is supplied from the outside and an ink reservoir for storing the ink supplied by way of the ink supply port; an ink supply flow passage from the ink supply port to the common ink chamber by way of the ink reservoir; an air purging passage branching off from the ink supply flow passage; and an air discharge valve capable of opening and closing the air purging passage.

In this inkjet printer, after having been temporarily stored in the ink reservoir, the ink supplied from an ink supply port is supplied to the common ink chamber from the ink reservoir. Moreover, ink is supplied to the respective nozzles from the common ink chamber by way of the individual ink flow passages, whereupon ink is ejected from the nozzles. The air purging passages are branched off from the ink supply flow passage which extends from the ink supply port to the common ink chamber by way of the ink reservoir. Specifically, the air purging passage is branched off at a position upstream of the position where the ink flow passages are branched to the individual pressure chambers from the common ink chamber.

Accordingly, in a case where air in the ink supply flow passage must be purged in conjunction with ink to be supplied, such as a case where ink is supplied to a virgin inkjet printer for the first time, when ink is supplied into the ink supply flow passage from the ink supply port with the air discharge valve released, air in the ink supply flow passage flows to the air purging passage along with ink, thereby enabling easy purging of air from the inside of the ink supply flow passage. Namely, by branching the air purging passage from the ink supply flow passage, purging of air requires only low ink supply pressure as compared with a case where air is purged from a plurality of individual ink flow passages which correspond to the respective pressure chambers (nozzles) and have high resistance. As a result, a pump or the like required to supply ink from the ink supply port can be miniaturized.

According to another aspect of the invention, there is provided with the inkjet printer further including valve open/close device opening the air discharge valve when commencing purging of air from inside of the ink supply flow passage while ink is being supplied from the ink supply port to the ink supply flow passage and closing the air discharge valve when the purging operation has been completed.

In connection with the inkjet printer of the present invention, when ink is supplied for the first time or when an ink cartridge is replaced, there is performed purging operation for replacing, with ink, the air still remaining in the ink supply flow passage or external air trapped in the ink supply flow passage, to thus purge air. Here, the air discharge valve is released by the valve open/close device at the time of commencement of the purging operation. Hence, the air still remaining in the ink supply flow passage can be readily purged to the outside at appropriate timing by way of the air purging passage. Moreover, the air discharge valve is closed by the valve open/close device at the time of commencement of the purge operation, and hence discharge of excessive ink from the air purging passage can be prevented.

According to yet another aspect of the invention, there is provided with the inkjet printer further including cartridge detection device for detecting whether or not an ink cartridge is set at a predetermined loading position, and the purging operation is commenced when loading of a new ink cartridge is detected by the cartridge detection device. Accordingly, purging operation is started simultaneously with loading of an ink cartridge, and hence the air still remaining in the ink supply flow passage before loading of the ink cartridge or the air trapped in the ink supply flow passage before loading of the ink cartridge can be purged without fail.

According to still another aspect of the invention, there is provided with ink supplied by way of the ink supply port after commencement of the purging operation is filled in at least an ink supply flow passage and an air purging passage at the time of completion of the purging operation. As mentioned above, all of the ink remaining in the ink supply flow passage and the air purging passage is discharged with air before commencement of purging operation, thereby replacing the residual ink with newly-supplied ink. As a result, the air can be purged without fail.

According to still another aspect of the invention, there is provided with a filter for permitting passage of ink being disposed at a position upstream of the ink supply flow passage, and the air purging passage branches off from a portion of the ink supply flow passage downstream of the filter. The meshes of the filter used for filtering ink are set so as to become sufficiently smaller than a nozzle size, in order to prevent occurrence of clogging of the nozzle. For this reason, air becomes less likely to pass through the filter, thereby rendering air likely to stay around the filter. However, the air purging passage is branched off from a portion of the ink supply flow passage downstream of the filter, whereby the air that has remained in the vicinity of the filter during purging operation can be purged from the air purging passage without fail.

The air having passed through the filter is in the form of small bubbles, because of fine meshes of the filter. The majority of the bubble-shaped air can be purged from the position upstream of the common ink chamber, thereby preventing to the extent possible, air of fine bubbles from flowing into the individual ink flow passages, each having a small flow passage area, and adhering to interior walls of the ink flow passages.

According to still another aspect of the invention, there is provided with the air purging passage branches off from an area of the ink supply flow passage upstream of the ink reservoir. Consequently, air of fine bubbles having passed through the filter can be purged to the outside by way of the air purging passage before flowing into the ink reservoir, thereby preventing, to the extent possible, the bubble-shaped air from flowing into areas downstream of the ink reservoir; particularly, the individual ink flow passages, each having a small flow passage area.

According to still another aspect of the invention there is provided with the ink supply flow passage has an ink drop flow passage extending from the ink supply port in an essentially-U-shaped form within the single plane and reaching an ink drop port of the ink reservoir; and the air purging passage branches off from a U-shaped extremity of the ink drop flow passage. As mentioned above, the air purging passage is branched off from the U-shaped extremity of the ink drop flow passage extending in a U-shaped manner between the filter and the ink reservoir, thereby rendering the air having passed through the filter easy to flow to the air purging passage.

According to still another aspect of the invention, there is provided with the air purging passage branches off from an ink inlet passage for introducing ink into the common ink chamber. Accordingly, the air of fine bubbles having passed through the filter can be purged to the outside by way of the air purging passage before flowing from the common ink chamber into the individual ink flow passages, each having a small flow passage area. Moreover, the air purging passage is branched off from the ink inlet passage and guides ink into the common ink chamber located at a downstream end of the ink supply flow passage. Hence, flow of the ink remaining in the ink supply flow passage into the individual ink flow passages can be prevented more reliably.

According to still another aspect of the invention, there is provided with the air purging passage extends from a position where the air purging passage branches off from the ink supply port, upward toward an air outlet for discharging air to the outside. Consequently, the air having flowed from the ink supply flow passage into the air purging passage can be purged to the outside from the air outlet reliably without remaining in the air purging passage by buoyancy of the air.

According to still another aspect of the invention, there is provided, in a state where the air purging passage is released, flow passage resistance of the air purging passage is lower than a total of flow passage resistance of a portion of the ink supply flow passage located downstream of the position where the air purging passage branches off from the ink supply flow passage and flow passage resistance of the individual ink flow passages. Consequently, the ink in the ink supply flow passage easily flows from the branch position toward the air purging passage having flow passage resistance lower than that of the individual ink flow passages. Therefore, the air can be purged readily even when the ink supply pressure is comparatively low.

DESCRIPTION OF THE PREFERRED EMBODIMENTS

Figure 1:
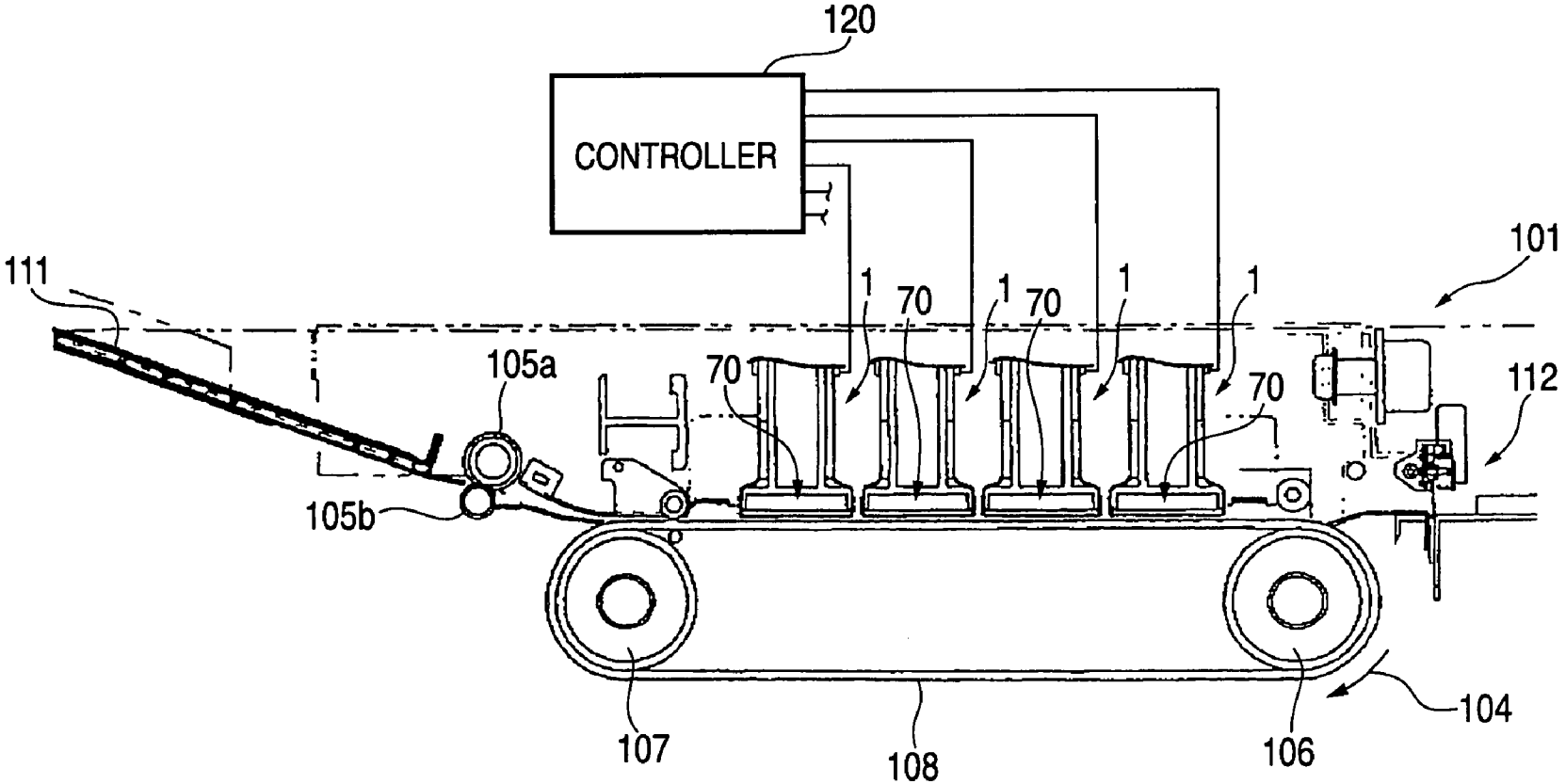
FIG. 1 is a schematic block diagram of an inkjet printer according to a first embodiment of the present invention.

FIG. 1 is a schematic diagram of an inkjet printer according to a first embodiment of the present invention. An inkjet printer 101 is a color inkjet printer having four inkjet heads 1. The inkjet printer 101 is configured such that a paper feed section 111 is provided on the left side of the printer in the drawing and such that a paper output section 112 is provided on the right side of the same in the drawing.

A paper transport path along which paper is transported from the paper feed section 111 toward the paper output section 112 is formed in the inkjet printer 101. A pair of feed rollers 105*a*, 105*b* for transporting in a nipped manner paper which is a recording medium are disposed at a position immediately downstream of the paper feed section 111. Paper is transported from left to right in the drawing by the pair of feed rollers 105*a*, 105*b*. Two belt rollers 106, 107 and a transport belt 108 endlessly wrapped around the rollers 106, 107 are disposed at an intermediate position of the paper transport path. An outer peripheral surface; that is, a transport surface, of the transport belt 108 is treated with silicon. The transport belt is arranged so that the paper transported by the pair of feed rollers 105*a*, 105*b* can be transported downstream (rightward) by rotating the belt roller 106 in a clockwise direction (in the direction of an arrow 104) in the drawing while retaining the paper on the transport surface of the transport belt 108 by adhesive force thereof.

Each of the four inkjet heads 1 has a head main body 70 at a lower end thereof. The head main body 70 has a rectangular cross-sectional surface, and the head main bodies 70 are arranged close to each other such that the longitudinal directions of the head main bodies are aligned in a direction perpendicular to the paper transport direction (i.e., a direction perpendicular to the paper in FIG. 1). In short, the printer 101 is a line printer. Respective bottom surfaces of the four head main bodies 70 oppose the paper transport path, and a plurality of nozzles 8 (see FIG. 5), each having a minute diameter, are provided in the respective bottom surfaces. Four ink cartridges 121 (see FIG. 12) storing magenta ink, yellow ink, cyan ink, and black ink, respectively, are set at predetermined loading positions, and ink is supplied to the head main bodies 70 from these four ink cartridges 121, whereupon ink of respective colors is ejected.

The head main bodies 70 are arranged such that a small gap is formed between the lower surfaces of the respective head main bodies and the transport surface of the transport belt 108, and the paper transport path is defined in this gap. By this configuration, when the paper transported over the transport belt 108 passes positions immediately downstream of the four head main bodies 70, ink of respective colors is ejected from the nozzles 8 toward an upper surface of paper; that is, a print surface of the same, whereby a desired color image can be formed on the paper.

The inkjet printer 101 has a controller 120 for controlling ejection of ink from the four inkjet heads 1, transport of paper by the belt rollers 106, 107, purging of air from the inside of the inkjet heads, and various operations of the printer 101. The controller 120 comprises a CPU (Central Processing Unit) serving as an arithmetic processing unit; ROM (Read-Only Memory) where a program to be executed by the CPU and data used by the program are stored; RAM (Random Access Memory) for temporarily storing data during execution of the program; and an input/output interface or a bus.

Figure 2:
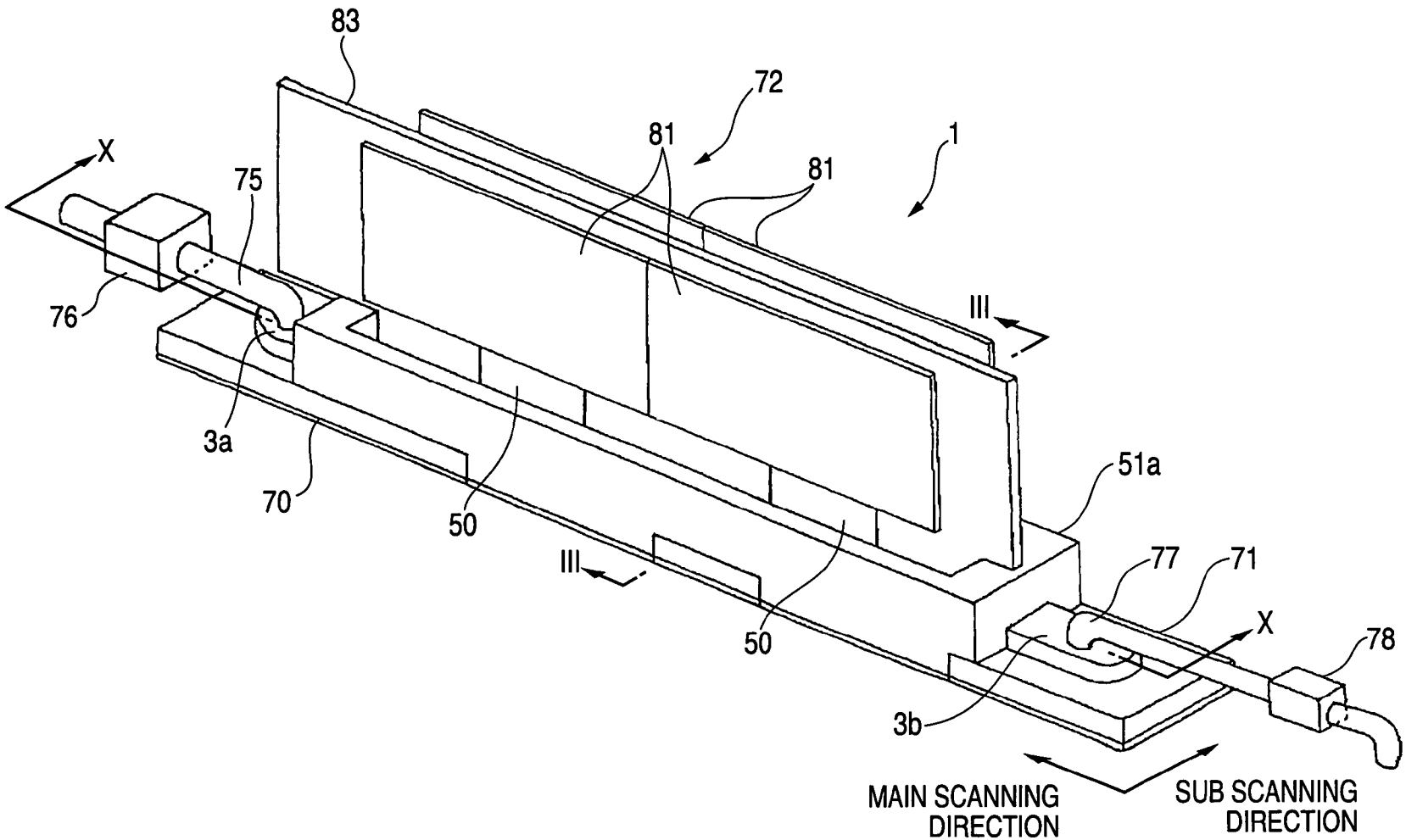
FIG. 2 is a perspective view of the inkjet head.
Figure 3:
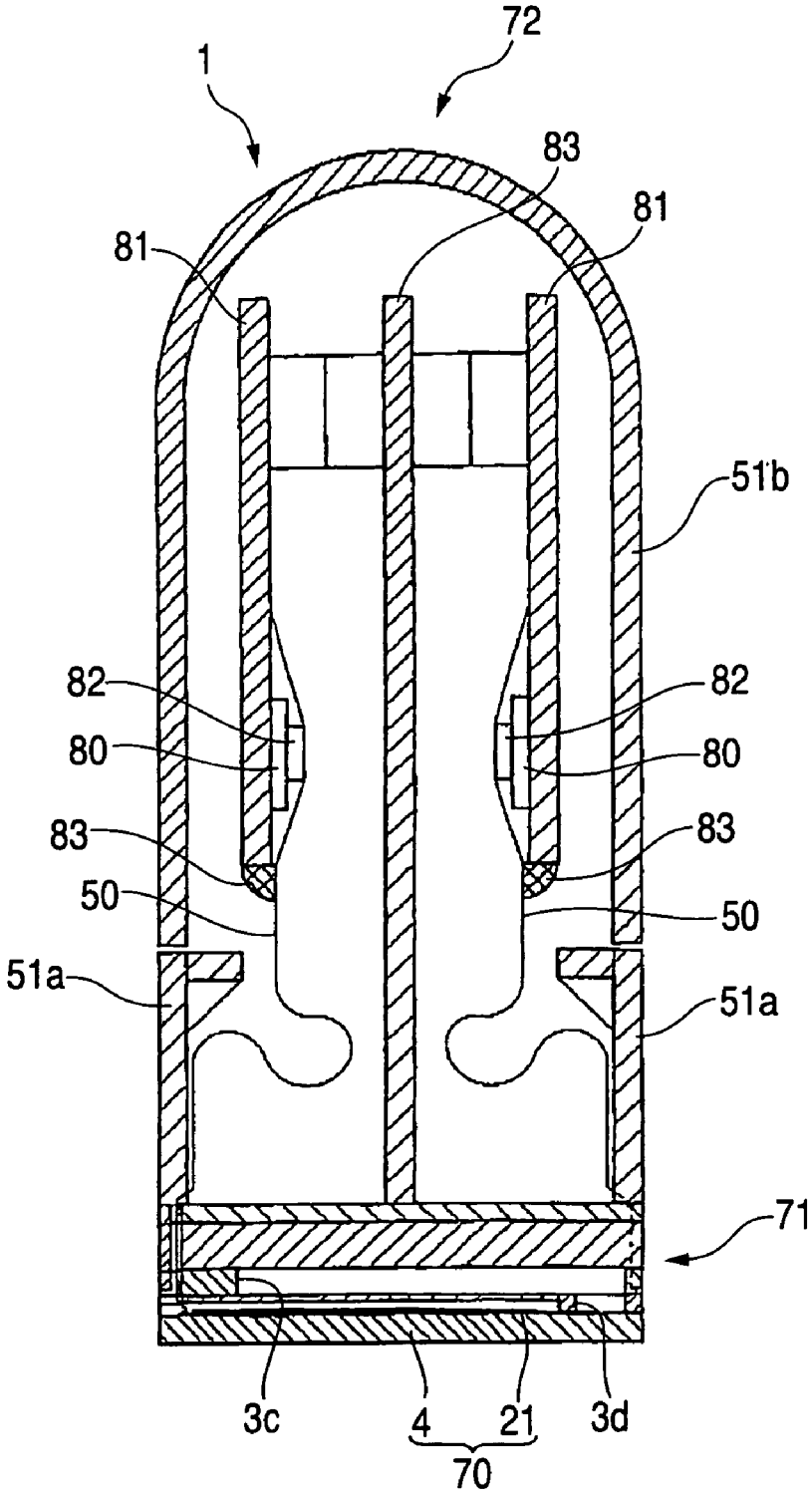
FIG. 3 is a cross-sectional view taken along line III-III shown in FIG. 2.

Next, the inkjet head 1 will be described in detail. As shown in FIGS. 2 and 3, the inkjet head 1 comprises the head main body 70 which extends in a main scanning direction for ejecting ink on paper and has the shape of a rectangular plane surface; a reservoir unit 71 which is disposed on an upper surface of the head main body 70 and in which is formed an ink reservoir 3*c* for storing ink to be supplied to the head main body 70; a head control section 72 which is disposed above the reservoir unit 71 and controls the head main body 70; and a lower cover 51*a* and an upper cover 51*b* for protecting the inside of the inkjet head 1 from splashes of ink. The upper cover 51*b* is omitted from FIG. 2 for convenience of explanation.

The head main body 70 includes a flow passage unit 4 having ink flow passages formed therein; and a plurality of actuator units 21 bonded to the upper surface of the flow passage unit 4. The flow passage unit 4 and the actuator unit 21 assume a laminated structure formed by stacking and bonding a plurality of thin plates.

An ink outflow passage 3*d* is formed at a lower end of the reservoir unit 71 in a downwardly-projecting manner. The reservoir unit 71 and the flow passage unit 4 are connected together at only an opening section formed in the lower end of the ink outflow passage 3*d*. Areas of the reservoir unit 71 other than the ink outflow passage 3*d* are upward of and separated from the head main body 70 when viewed from the top. A Flexible Printed Circuit (FPC) 50 which is a power feeding member is electrically connected to an upper surface of the actuator unit 21. This FPC 50 is drawn to the outside of the actuator unit 21 from both sides thereof in a sub-scanning direction.

The reservoir unit 71 is for storing the ink supplied to an ink supply port 3*a* from the corresponding ink cartridge 121 (see FIG. 12) in the ink reservoir 3*c* and supplying the thus-stored ink to the flow passage unit 4. This reservoir unit 71 has a planar shape essentially identical with that of the flow passage unit 4. At one end of the reservoir unit 71 in the main scanning direction (a left end in FIG. 2) are disposed an ink supply tube 75 connected to the ink supply port 3*a* and a supply pump 76 for supplying ink from the ink supply port 3*a* to the inside of the reservoir unit 71. Meanwhile, at the other end of the reservoir unit 71 (a right end in FIG. 2) are disposed an air purging tube 77 connected to an air purging passage 67 for purging air from the inside of an ink supply flow passage 65 (see FIG. 10) formed in the reservoir unit 71, and an air purging valve 78 capable of opening and closing the air purging passage 67.

The head control section 72 controls various operations of the inkjet head 1, such as ejection of ink from the nozzles 8 (see FIG. 5), in accordance with a command from the controller 120, and comprises a main board 83, sub-boards 81, and driver ICs 80. The main board 83 assumes a rectangular shape extending in the main scanning direction and is provided upright on the upper surface of the reservoir unit 71. The sub-boards 81 are arranged on either side of the main board 83 in parallel with the main board 83 and are electrically connected to the main board 83. The driver ICs 80 are for generating a signal to be used for driving the actuator units 21 and are mounted on respective surfaces of the sub-boards 81 equipped with heat sinks 82, the surfaces facing the main board 83. The sub-boards 81 and the driver ICs 80 are electrically connected to the FPCs 50 drawn from the respective sides of the actuator unit 21 in the sub-scanning direction. The FPCs 50 are electrically connected to the driver ICs 80 and the sub-boards 81 so as to transmit the signal output from the sub-boards 81 to the driver ICs 80 and to transmit the drive signals output from the driver ICs 80 to the actuator units 21 of the head main body 70.

The lower cover 51*a* is an essentially square tubular housing and disposed on the head main body 70 so as to cover from the outside the FPCs 50 drawn upward from the reservoir unit 71. The FPCs 50 are housed in a released state at positions above the actuator unit 21 within the lower cover 51*a* so as to be protected from stress.

The upper cover 51*b* is an angular housing having an arched ceiling and placed on the lower cover 51*a* so as to cover the main board 83 and the sub-boards 81 from the outside. In a state where the lower cover 51*a* and the upper cover 51*b* are arranged, the width of the lower cover 51*a* and that of the upper cover 51*b* in the sub-scanning direction are set so as to fall within the width of the head main body 70 in the sub-scanning direction.

Figure 4:
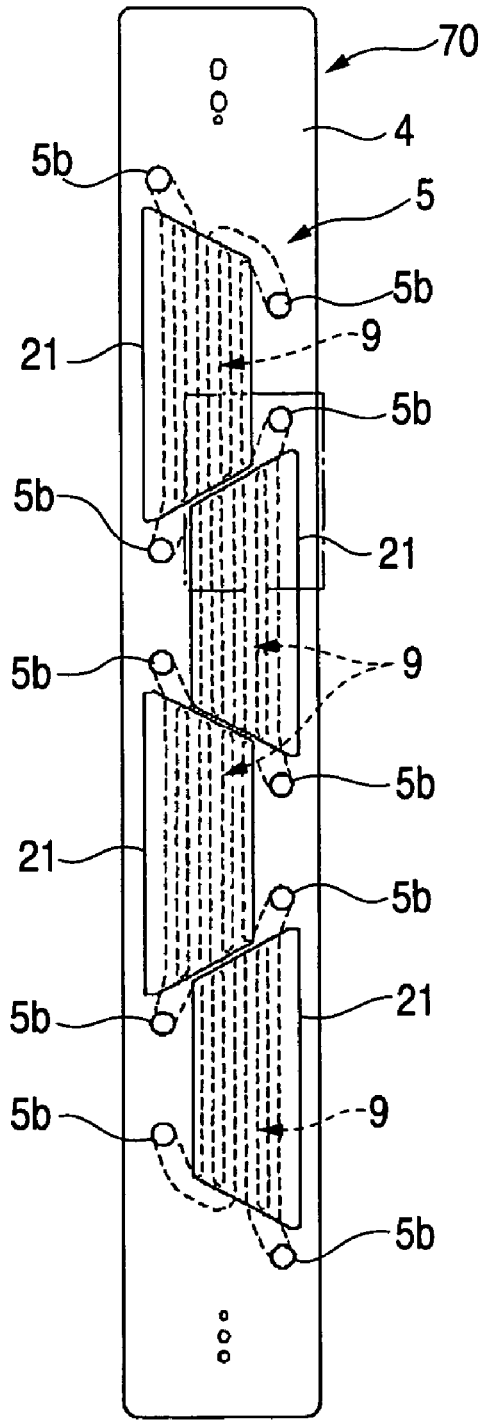
FIG. 4 is a plan view of a head main body.
Figure 5:
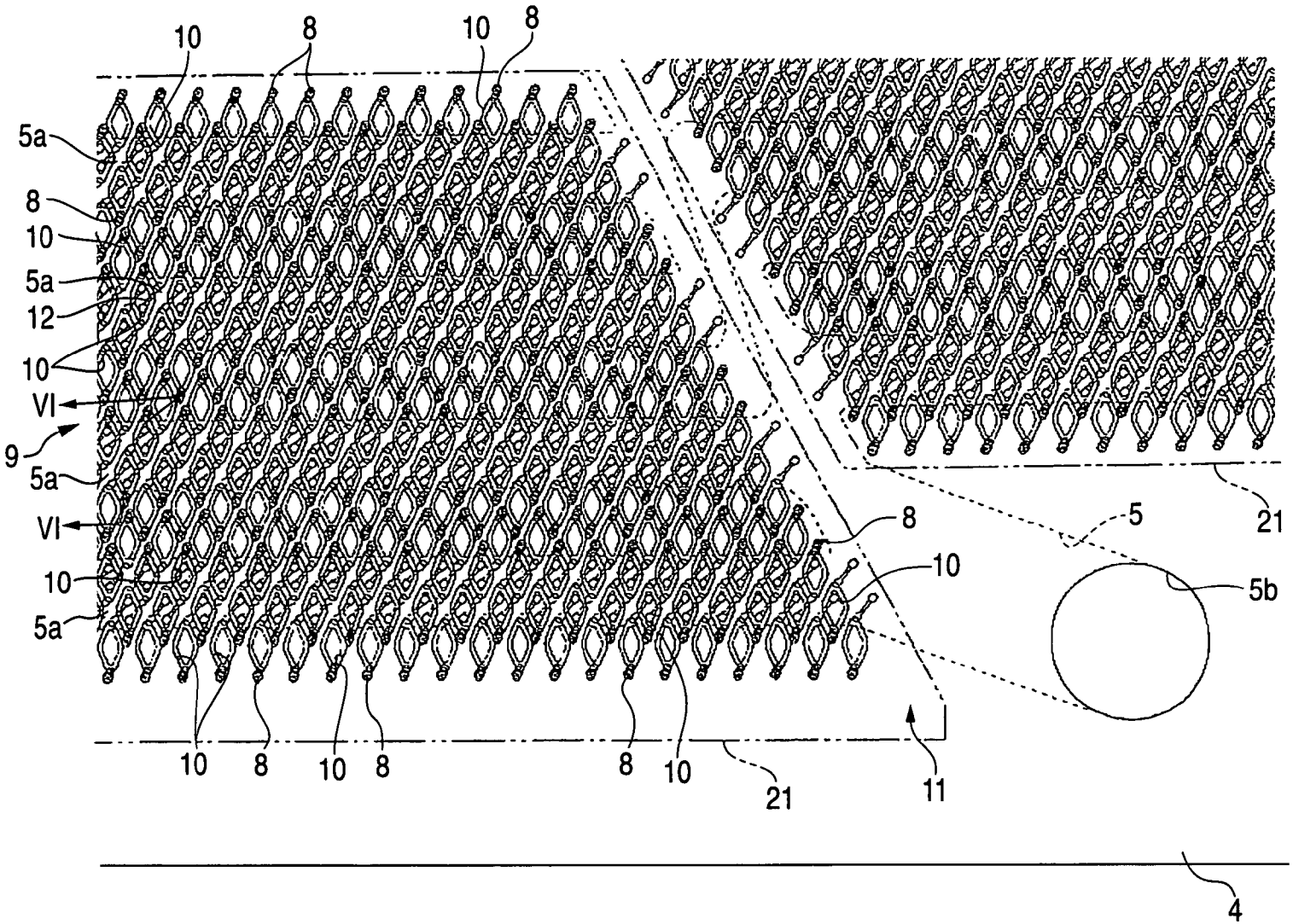
FIG. 5 is an enlarged view of an area enclosed by a dashed line shown in FIG. 4.

Next, the structure of the head main body 70 will be described in detail. As shown in FIGS. 4 and 5, the head main body 70 has the flow passage unit 4 in which are formed a plurality of pressure chambers 10 constituting a pressure chamber group 9, and the nozzles 8. A plurality of trapezoidal actuator units 21 arranged in two rows in a staggered pattern on the upper surface of the flow passage unit 4. In more detail, the respective actuator units 21 are arranged such that a pair of parallel sides (upper and lower sides) of each actuator unit are arranged along the longitudinal direction of the flow passage unit 4. Further, oblique sides of the adjacent actuator units 21 overlap each other in the widthwise direction of the flow passage unit 4.

Areas of the lower surface of the flow passage unit 4 opposing the areas where the actuator units 21 are bonded serve as ink ejection areas. As shown in FIG. 5, the plurality of nozzles 8 are arranged in a matrix pattern on the surface of the ink ejection area. The pressure chambers 10, each remaining in communication with one nozzle 8, are also arranged in a matrix pattern. The plurality of pressure chambers 10 provided in the area of the upper surface of the flow passage unit 4 opposing the area where one actuator unit 21 is bonded constitute one pressure chamber group 9.

Each nozzle 8 has a tapered opening and is in communication with a sub-manifold 5*a* which is a branch flow passage of a manifold 5, by way of the pressure chamber 10 having a substantially-rhomboidal shape when viewed from above and an aperture 12. An opening section 5*b* of the manifold 5 provided on the upper surface of the flow passage unit 4 is joined to the ink outflow passage 3*d* provided on the lower surface of the reservoir unit 71. Ink is supplied from the reservoir unit 71 to the flow passage unit 4 by way of the ink outflow passage 3*d*. In FIG. 5, in order to make the drawings easy to comprehend, the pressure chambers 10 (the pressure chamber group 9), the opening sections 5*b*, and the apertures 12, which are located below the actuator unit 21 and should be drawn in broken lines, are drawn in solid lines.

Figure 6:
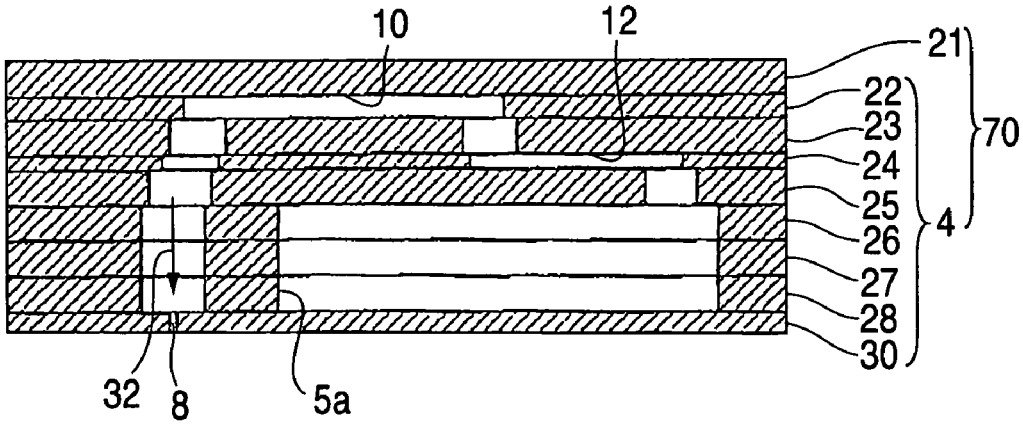
FIG. 6 is a cross-sectional view taken along line VI-VI shown in FIG. 5.

The cross-sectional structure of the head main body 70 will now be described. As shown in FIG. 6, the nozzle 8 is in communication with the sub-manifold 5*a* by way of the pressure chamber 10 and the aperture 12. An individual ink flow passage 32, which extends from the exit of the sub-manifold 5*a* to the nozzle 8 by way of the aperture 12 and the pressure chamber 10, is formed for each pressure chamber 10 in the head main body 70.

Figure 7:
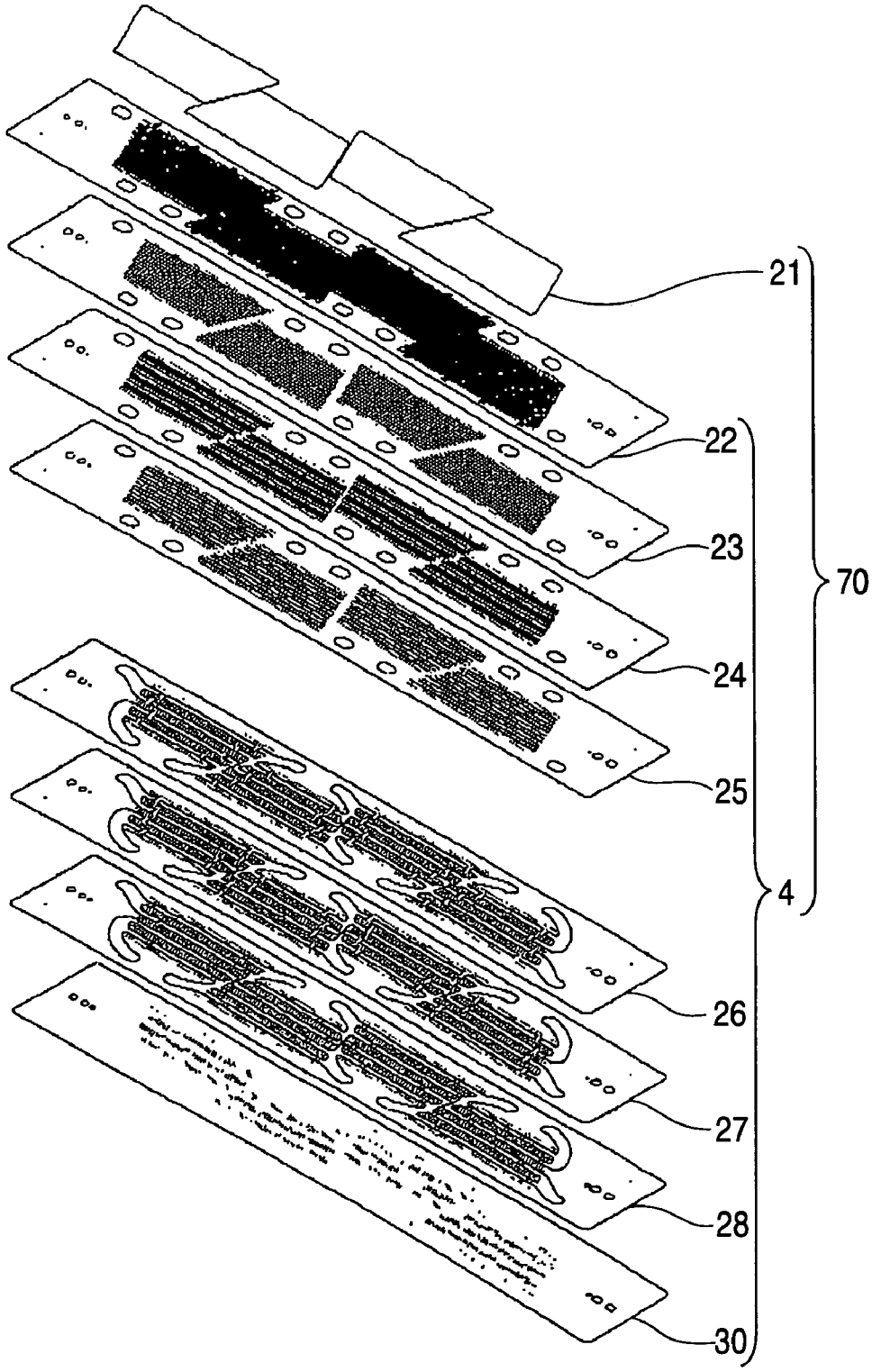
FIG. 7 is a fragmentary exploded, perspective view of the head main body.

As shown in FIG. 7, the head main body 70 has a laminated structure in which are stacked, from top to bottom, the actuator unit 21, a cavity plate 22, a base plate 23, an aperture plate 24, a supply plate 25, manifold plates 26, 27, and 28, and a nozzle plate 30. The flow passage unit 4 is constituted of all eight metal plates but not the actuator unit 21.

As will be described in detail later, the actuator unit 21 is formed by stacking four piezoelectric sheets 41 to 44 (see FIG. 8A). Only the top layer is taken as a layer which becomes an active layer upon exposure to an applied electric field (hereinafter described simply as a "layer having an active layer"), and the remaining three layers are taken as inactive layers. The cavity plate 22 is a metal plate in which are formed a plurality of substantially-rhomboidal openings corresponding to the pressure chambers 10. The base plate 23 is a metal plate in which are formed, for a single pressure chamber 10 of the cavity plate 22, a communication hole for connecting the pressure chamber 10 to the aperture 12 and another communication hole for connecting the pressure chamber 10 to the nozzle 8. The aperture plate 24 is a metal plate in which are formed, for a single pressure chamber 10 of the cavity plate 22, two holes, the aperture 12 formed in a half-etched area for connecting the two holes, and a communication hole for connecting the pressure chamber 10 to the nozzle 8. The supply plate 25 is a metal plate in which are formed, for a single pressure chamber 10 of the cavity plate 22, a communication hole for connecting the aperture 12 to the sub-manifold 5*a* and the communication hole for connecting the pressure chamber 10 to the nozzle 8. The manifold plates 26, 27, and 28 are metal plates in which are formed, for a single pressure chamber 10 of the cavity plate 22, the communication hole for connecting the pressure chamber 10 to the nozzle 8 as well as holes connected together during stacking to thus constitute the sub-manifold 5*a*. The nozzle plate 30 is a metal plate in which is formed the nozzle 8 for a single pressure chamber 10 of the cavity plate 22.

These eight metal plates are stacked after having been aligned with each other such that the individual ink flow passage 32, such as that shown in FIG. 6, is formed. The individual ink flow passage 32 extends upward from the sub-manifold 5*a*, then extends horizontally through the aperture 12, extends upward again, extends horizontal again through the pressure chamber 10, extends in a downwardly oblique direction departing from the aperture 12 over some distance, and extends vertically, downward toward the nozzle 8.

The configuration of the actuator unit 21 stacked on the to player cavity 22 of the flow passage unit 4 will now be described. FIG. 8A is an enlarged cross-sectional view of the actuator unit 21 and the pressure chamber 10. FIG. 8B is a plan view showing the geometry of an individual electrode provided on the surface of the actuator unit 21.

Figure 8A:
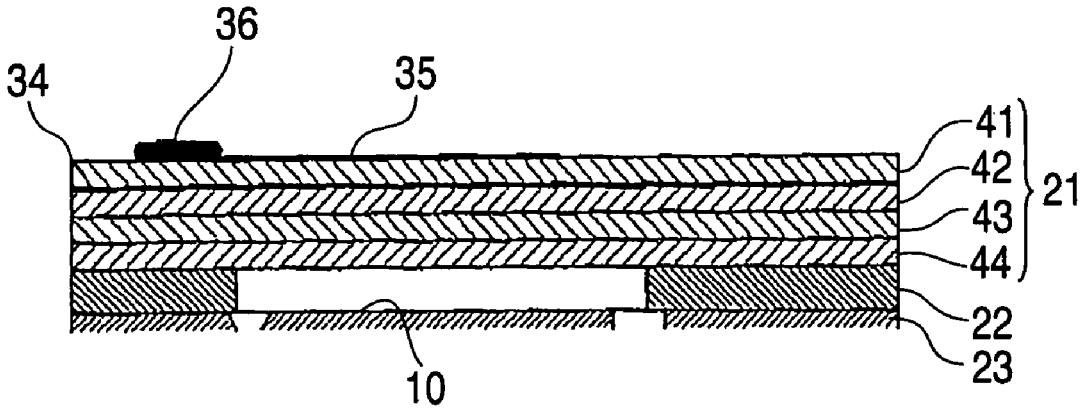
FIG. 8A is a fragmentary enlarged cross-sectional view of an actuator unit.
Figure 8B:
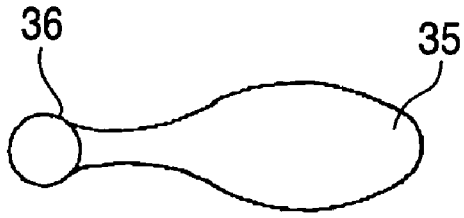
FIG. 8B is a plan view of an individual electrode.

As shown in FIG. 8A, the actuator unit 21 includes four piezoelectric sheets 41, 42, 43, and 44 which are formed so as to assume the same thickness; that is, 15 m each or thereabouts. These piezoelectric sheets 41 to 44 are formed into continuos layered flat plates (continuous flat plate layers) which are arranged so as to straddle the plurality of pressure chambers 10 formed within one ink ejection region in the head main body 70. As a result of the piezoelectric sheets 41 to 44 being arranged as continuous flat plate layers so as to straddle the plurality of pressure chambers 10, individual electrodes 35 can be arranged at high density on the piezoelectric sheet 41 through use of, e.g., a screen printing technique. Therefore, the pressure chambers 10 which are to be formed at positions corresponding to the individual electrodes 35 can also be arranged at high density, thereby enabling printing of a high-resolution image. The piezoelectric sheets 41 to 44 are formed from lead-zirconate-titanate(PZT)-based ceramic material having high ferroelectricity.

The individual electrode 35 is formed on the top layer; that is, the piezoelectric sheet 41. A common electrode 34 which has a thickness of about 2 m and is formed over the entirety of the sheet is interposed between the top layer piezoelectric sheet 41 and the piezoelectric sheet 42 located below it. No electrode is interposed between the piezoelectric sheets 42 and 43. The individual electrode 35 and the common electrode 34 are formed from metal material; e.g., Ag—Pd-based material.

As shown in FIG. 8B, the individual electrode 35 has a thickness of about 1 m and assumes a substantially-rhomboidal planar shape which essentially is geometrically analogous to the pressure chamber 10 shown in FIG. 5. One of sharp-edged portions of the substantially-rhomboidal individual electrode 35 is extended, and a circular land section 36 which is electrically connected to the individual electrode 35 and has a diameter of about 160 m is provided at the extremity of the extended portion. The land section 36 is formed from, e.g., gold containing glass frit. As shown in FIG. 8A, the land section 36 is bonded to the surface of the extended portion of the individual electrode 35. The land section 36 is electrically bonded to a contact point provided on the FPC 50.

The common electrode 34 is grounded in an unillustrated area. Thereby, the common electrode 34 is held at a ground potential in all the areas corresponding to the pressure chamber 10. The individual electrode 35 is connected to the driver IC 80 by way of the FPC 50 and the land section 36, which are provided for each individual electrode 35 and have independent separate lead wires (see FIGS. 2 and 3).

Next will be described a method for actuating the actuator unit 21. In the actuator unit 21, the polarizing direction of the piezoelectric sheet 41 corresponds to a thicknesswise direction of the piezoelectric sheet. Specifically, the actuator unit 21 is embodied in the form of a so-called unimorph type, wherein the upper (in a direction opposite to the pressure chamber 10) single piezoelectric sheet 41 is taken as a layer where an active layer exists; and wherein lower (in a direction toward the pressure chamber 10) three piezoelectric sheets 42 to 44 are taken as inactive layers. Accordingly, provided that the individual electrode 35 is set to a predetermined positive or negative potential, when the electric field and the polarizing direction are oriented in the same direction, the electric field application section sandwiched between the electrodes in the piezoelectric sheet 41 acts as an active layer, whereupon the actuator unit 21 contracts in a direction perpendicular to the polarizing direction by the piezoelectric transverse effect. In the meantime, the piezoelectric sheets 42 to 44 are not affected by the electric field and do no contract spontaneously. Hence, deformation difference arises between the upper piezoelectric sheet 41 and the lower piezoelectric sheets 42 to 44 in a direction perpendicular to the polarizing direction. As a result, the piezoelectric sheets 41 to 44 as a unit attempt to deform in a convex manner toward an inactive side (uniform deformation). At this time, as shown in FIG. 8(*a*), the lower surface of the unit consisting of piezoelectric sheets 41 to 44 is fixed to the upper surface of the cavity sheet 22 defining the pressure chamber 10. Consequently, the piezoelectric sheets 41 to 44 are deformed so as to become convex toward the pressure chamber 10. Therefore, the volume of the pressure chamber 10 is decreased, which in turn increases the pressure of the ink stored in the pressure chamber 10, with the result that ink is ejected from the nozzle 8 remaining in communication with the pressure chamber 10. Subsequently, when the individual electrode 35 is returned to the same potential as that of the common electrode 34, the piezoelectric sheets 41 to 44 return to their original forms, whereby the volume of the pressure chamber 10 returns to its original volume. Therefore, ink is sucked from the manifold 5 by the pressure chamber 10.

Figure 9:
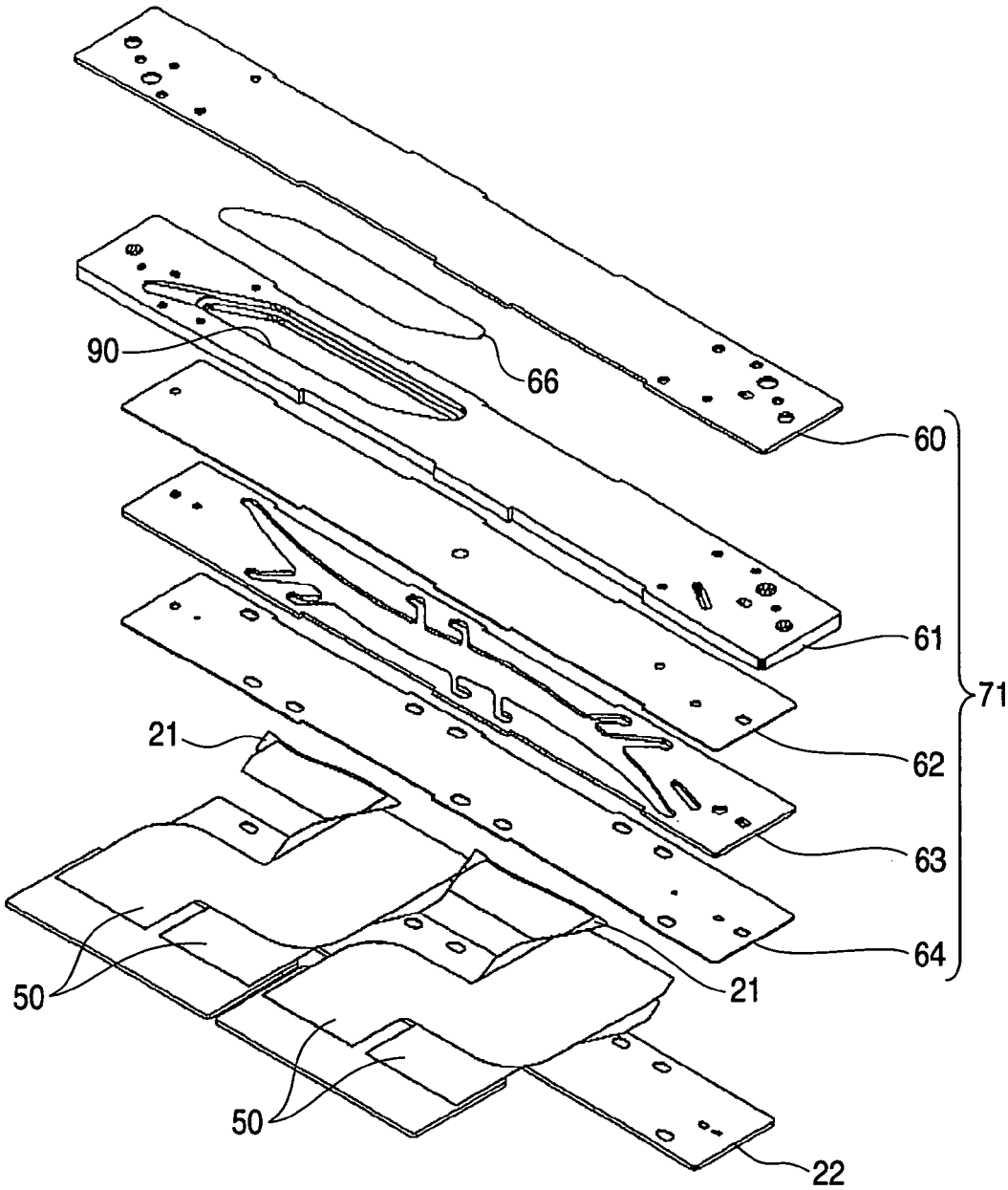
FIG. 9 is an exploded, perspective view of a reservoir unit, an FPC, and a cavity plate.
Figure 10:
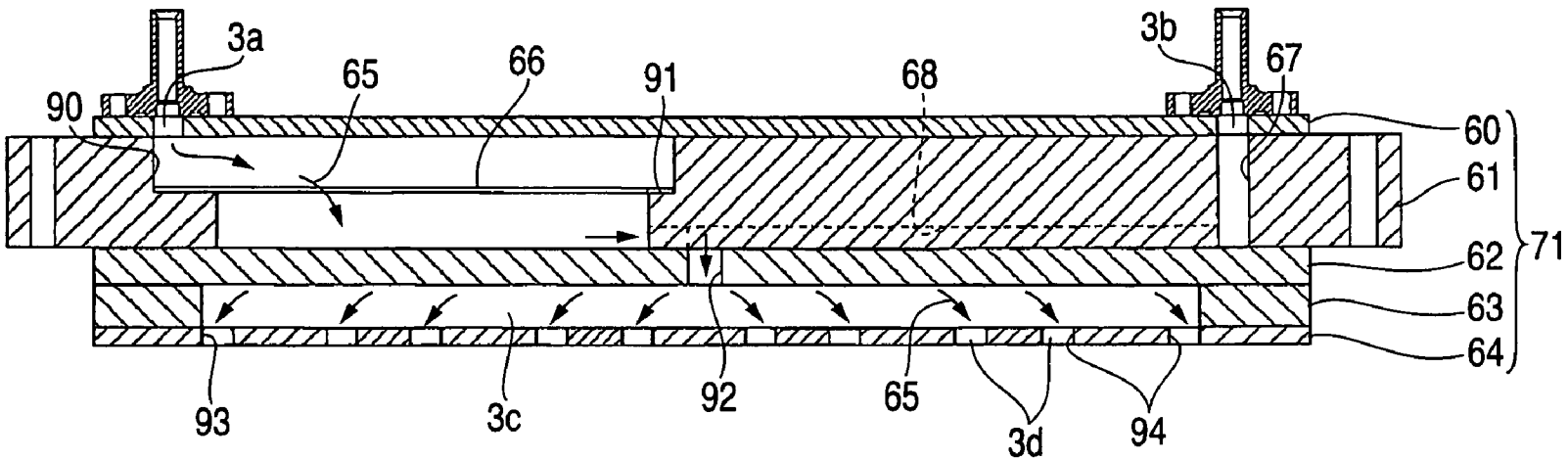
FIG. 10 is a cross-sectional view taken along line X-X shown in FIG. 2.
Figure 11:
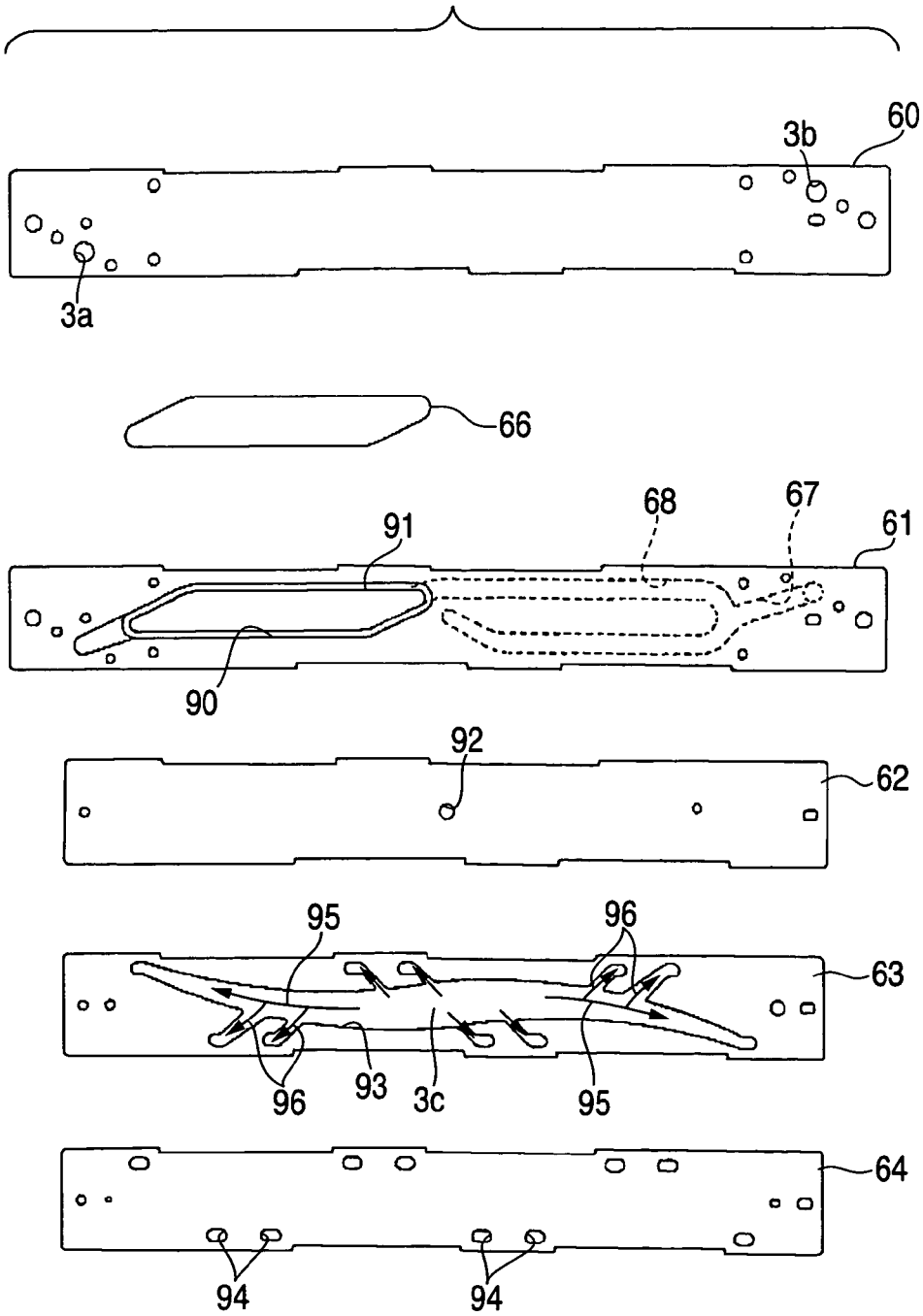
FIG. 11 is a plan view showing respective plates constituting the reservoir unit.

Next, the structure of the reservoir unit 71 is described in detail. As shown in FIGS. 9 to 11, the reservoir unit 71 has a structure in which five plates; a first reservoir plate 60, a second reservoir plate 61, a third reservoir plate 62, a fourth reservoir plate 63, and a fifth reservoir plate 64, are stacked in this order from the top the reservoir unit 71 is placed on the head main body 70 (i.e., the actuator unit 21 and the cavity plate 22). The respective reservoir plates 60 to 64 are substantially rectangular metal plates extending in the main scanning direction. As shown in FIG. 10, the reservoir unit 71 comprises the ink supply port 3*a* into which ink is supplied from the outside; the ink reservoir 3*c* for storing the ink supplied from the ink supply port 3*a*; the ink supply flow passage 65 extending from the ink supply port 3*a* to the manifold 5 by way of the ink reservoir 3*c*; and a filter 66 which is provided at a position in the ink supply flow passage 65 higher than the ink reservoir 3*c* and filtrates ink.

The ink supply port 3*a* to which the ink supply tube 75 (see FIG. 2) is connected and an air purging port 3*b* to which an air purging tube 77 (see FIG. 2) is connected are provided at the respective ends of the first reservoir plate 60 in the main scanning direction.

A filter attachment hole 90 which is in communication with the ink supply port 3*a* and is used for attaching the filter 66 is formed in a left area of the second reservoir plate 61 shown in FIG. 11. A stepped filter support section 91 is formed at an arbitrary position on the filter attachment hole 90 in the thicknesswise direction thereof and along an internal periphery of the filter attachment hole 90. The filter 66 is supported within the filter attachment hole 90 by this filter support section 91.

The filter 66 is for filtrating the ink in the ink supply flow passage 65 and preventing adhesion of extraneous matter or the like to the downstream nozzles 8 or the pressure chambers 10. In order to prevent extraneous matter or the like, which may cause clogging in the nozzles 8, from flowing downstream, the meshes of the filter 66 are made sufficiently smaller than the nozzle diameter. Moreover, in the present embodiment, filtration resistance of the filter 66 becomes smaller toward the right end of the same shown in FIG. 10. For this reason, the ink supplied from the ink supply port 3*a* located in the left side of FIG. 10 flows much more easily as it goes toward the downstream end of the filter 66. As mentioned previously, since the meshes of the filter 66 have become small, air easily remains in the vicinity of the filter 66. However, the flow passage resistance of the filter becomes smaller toward its right-side downstream end, and air is easily purged along with the flow of the ink. For instance, if the meshes are made larger toward the right end of the filter for rendering the flow passage resistance of the filter 66 small, air can be purged more readily.

An ink drop flow passage 68 which remains in communication with the filter attachment hole 90 and reaches to an ink drop port 92 of the ink reservoir 3*c* is formed in the lower surface of a right-side area of the second reservoir plate 61 shown in FIG. 11. The ink drop port 92 is formed in substantially the center of the third reservoir plate 62 when viewed from the above. The ink drop flow passage 68 is formed into a U-shaped form which extends from the filter attachment hole 90 in the rightward direction in FIG. 11; which is reversed and extends leftward; and which is in communication with the ink drop port 92 located substantially at the center.

A reservoir hole 93 forming an ink reservoir 3*c* which is narrow and elongated in the main scanning direction (the horizontal direction in FIG. 11) is formed in the fourth reservoir plate 63. This reservoir hole 93 occupies a considerably wide area with respect to the entire area of the plate. The upper and lower sides of the reservoir hole 93 are closed with the third and fifth reservoir plates 62 and 64. The ink reservoir 3*c* is branched and extends to a position where the ink reservoir overlaps the opening section 5*b* (see FIG. 4) of the manifold 5 of the flow passage uni4 4 when viewed from the above. The ink reservoir 3*c* assumes a plane geometry which is symmetrical about a point with respect to the center position of the fourth reservoir plate 63 where ink is dropped from the ink drop port 92. Accordingly, as shown in FIG. 11, the ink having flowed into the ink reservoir 3*c* from the ink drop port 92 flows along two main flow passages 95 which extend from the center of the ink reservoir 3*c* toward two ends thereof formed in the neighborhoods of both ends of the ink reservoir 3*c* in the main scanning direction. Moreover, the ink flows along eight branched flow passages 96 which are branched off from the two main flow passages 95 and extend toward ends formed in the sub-scanning direction.

An elongated ink outflow hole 94 forming the ink outflow passage 3*d* for letting the ink outflow from the inside of the ink reservoir 3*c* to the manifold 6 is formed in the sixth reservoir plate 64. Five ink outflow holes 94 are formed on either side of the fifth reservoir plate 64 with reference to the widthwise direction thereof and at positions overlapping the opening section 6*b* of the manifold 5 when viewed from the above.

The ink supply flow passage 65 is formed so as to extend from the ink supply port 3*a* to the manifold 5 by way of the inside of the filter attachment hole 90, the ink drop flow passage 68, the ink reservoir 3*c*, and the ink outflow passage 4*d*. Moreover, ink is supplied from the ink supply flow passage 65 to the individual ink flow passages 62 of the flow passage unit 4 (see FIG. 6).

By the way, in this inkjet printer 101, when the ink cartridge 121 is first loaded in a virgin inkjet printer 101 or when the ink cartridge 121 having depleted of ink is replaced with a new ink cartridge, purging operation is performed for purging the air filled in the ink flow passage 65 or the air trapped during the course of replacement of the ink cartridge 121 under a command from the controller (see FIG. 1). Here, when an attempt is made to purge the air in the ink supply flow passage 65 at the time of purging operation, there is a necessity for causing the air to pass through the filter 66 having small meshes and large flow passage resistance and pass through the individual ink flow passages 32 that are branched off from the manifold 5 and have a small flow passage area. For this reason, the ink supply pressure exerted by the supply pump 76 during the course of the purging operation must be increased, which in turn renders the supply pump 76 bulky. Alternatively, the air in the ink supply flow passage 65 is not completely purged by a single purging operation, and the air that have passed through the filter 66 and assume the form of minute bubbles remains in the ink supply flow passage 65 or the individual ink flow passages 32. This may adversely affect the ink ejection characteristics of the nozzles 8. For this reason, the purging operation must be continuously performed several times for completely purging air.

As shown in FIGS. 10 and 11, the inkjet printer 101 of the present embodiment is provided with the air purging passage 67 that branches off from an area of the ink supply flow passage 65 downstream of the filter 66. As shown in FIG. 11, the air purging passage 67 branches off from the U-shaped extremity of the ink drop flow passage 68, thereby rendering the ink mixed with the air bubbles having passed through the filter 66 easy to flow into the air purging flow passage 67 from the ink drop flow passage 68 that is the main flow passage. Moreover, since the filter 66 having small meshes and large flow passage resistance poses difficulty in passage of air, the air is likely to remain in the upstream neighborhood of the filter 66. However, the air purging passage 67 is branched from the downstream area of the filter 66, whereby the air remaining in the vicinity of the filter 66 can be purged without fail by the purging operation.

As shown in FIG. 10, after having extended horizontally from the branch position, the air purging passage 67 extends upwardly toward the air purging port 3*b* for purging air to the outside. For this reason, the air does not remain in the air purging passage 67 and is purged from the air purging port 3*b* to the outside of the inkjet head 1 without fail by buoyancy of the air. The flow passage length and flow passage area of the air purging passage 67 are set so as to become smaller than a sum of the ink supply flow passage 65 located downstream of the branch position and the individual ink flow passages 32. Accordingly, the ink becomes easy to flow from the branch position toward the air purging passage 67 which is smaller in flow passage resistance than the individual ink flow passages 32. Hence, the air can be purged from the air purging passage 67 having small flow passage resistance without fail.

As shown in FIG. 11, in the present embodiment, the ink supply port 3*a* is provided at a lower corner portion of the end of the first reservoir plate 60 in the main scanning direction. In contrast, the air purging port 3*b* is provided at the corner portion of the first reservoir plate 60 which is symmetrical about the corner where the ink supply port 3*a* is provided, with respect to the center of the first reservoir plate 60.

In contrast, the filter attachment hole 90 which remains in communication with the ink supply port 3*a* and into which the filter 66 is set, the ink drop flow passage 68, and the air purging passage 67 re formed in the second reservoir plate 61. A communication section between the filter attachment hole 90 and the ink supply port 3*a* is situated at the corner in the vicinity of the lower left end of the second reservoir plate 61 shown in FIG. 11, and the portion of the air purging passage 67 extending upwardly for purging air to the outside is situated at the corner in the vicinity of the upper right end of the second reservoir plate 61 shown in FIG. 11.

Of the two ends of the ink reservoir 3*c* of the fourth reservoir plate 63, the left end shown in FIG. 11 is situated at the corner in the vicinity of the upper left end of the fourth reservoir plate 63, and the right end is situated at the corner in the vicinity of the right lower end of the fourth reservoir plate 63.

The ink supply flow passage 65 of the reservoir unit 71 is formed along a diagonal line from the lower left corner of the second reservoir plate 61 shown in FIG. 11 to an upper right corner of the same such that through hole and trench structures occupy a considerably large area of the entire area of the second reservoir plate 61. The ink supply flow passage 65 is formed in the fourth reservoir plate 63 stacked on the second reservoir plate with the third reservoir plate 62 sandwiched therebetween such that through holes occupy a considerably wide area of the entire area along a diagonal line from the upper left corner to the lower right corner, both being shown in FIG. 11.

To this end, the ink supply flow passage 65 of the second reservoir plate 651 formed in a large area and the ink supply flow passage 65 of the fourth reservoir plate 64 are arranged so as to cross each other in a direction in which the plates are stacked (i.e., the direction perpendicular to the paper of FIG. 11). Accordingly, the ink supply flow passage 65 and the air purging passage 67, both having low flow passage resistance, are formed, with a less local offset of stiffness and balanced strength, in the reservoir unit 71 formed by addition of the first reservoir plate 60 to the fifth reservoir plate 64. Namely, there can be configured an inkjet printer having a superior maintenance characteristic attributable to high air purging performance and a high assembly accuracy attributable to a well-balanced rigidity.

As shown in FIG. 2, the air purging valve 78 that can open and close the air purging passage 67 is provided in the air purging pipe 77 connected to the air purging port 3*b*. This air purging valve 78 is formed from an electromagnetic valve and is opened or closed in conjunction with a purging operation for purging air from the inside of the ink supply flow passage 65 while supplying ink to the ink supply flow passage 65, by a purge control section 72*a* provided in the head control section 72 of each inkjet head 1 (see FIG. 12).

Figure 12:
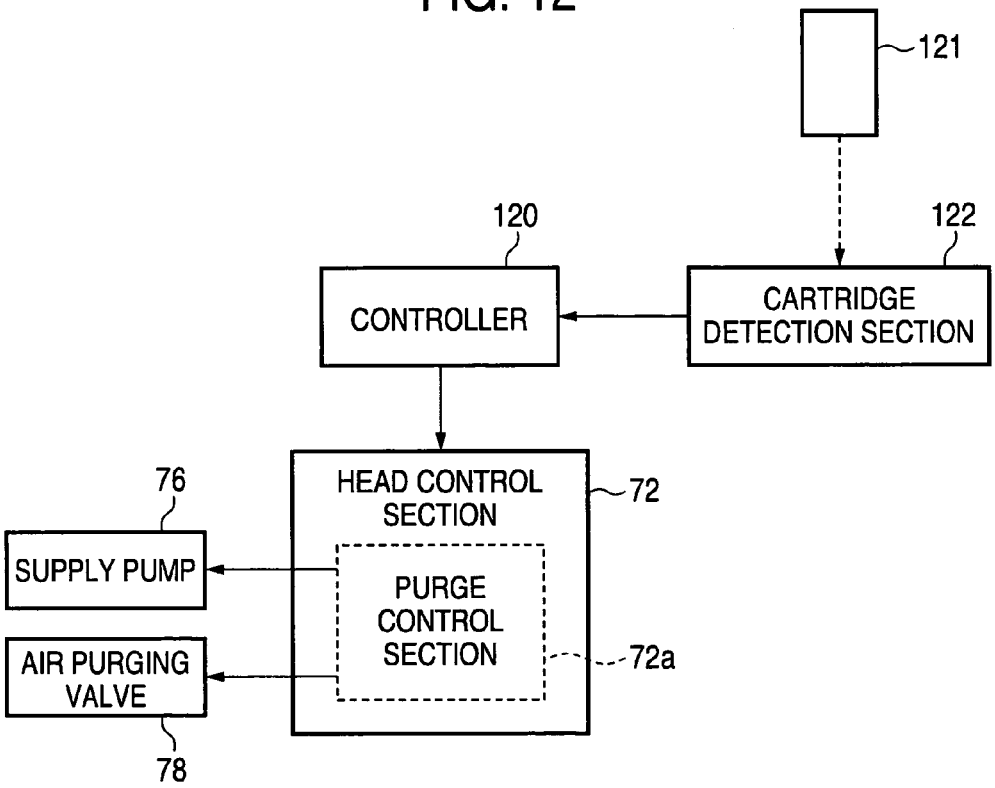
FIG. 12 is a functional block diagram pertaining to a purging operation.

The purge control section 72*a* for controlling purging operation will now be described by reference to a functional block diagram of FIG. 12. The purge control section 72*a* comprises a CPU of the head control section 72 mounted on a board 83; ROM storing a program for controlling a purging operation, data, or the like; and RAM for temporarily storing data during running of a program for controlling a purging operation.

When a signal output from a cartridge detection section 122 (cartridge detection device) for detecting presence of the ink cartridge 121 at a predetermined cartridge loading position is input to the controller 120, the controller 120 outputs a signal to the purge control section 72*a* of each head control section 72 for commencing a purging operation. Here, any of various known sensors, such as an optical sensor, a proximity sensor, or a limit switch, can be used as the cartridge detection section 122.

Upon receipt of, from the controller 120, a signal for commencing a purging operation, the purge control section 72*a* outputs to the supply pump 76 a startup signal for supplying ink from the ink supply port 3*a* to the reservoir unit 71, as well as outputting an open signal to the air purging valve 78 capable of opening and closing the air purging passage 67. As will be described later, the purge control section 72*a* is configured to terminate the purging operation after lapse of a predetermined period of time since commencement of the purging operation. A stop signal is output to the supply pump 76 at the time of completion of the purging operation, and a close signal is output to the air purging valve 78. This purge control section 72*a* corresponds to valve open/close device of the present invention.

Figure 13:
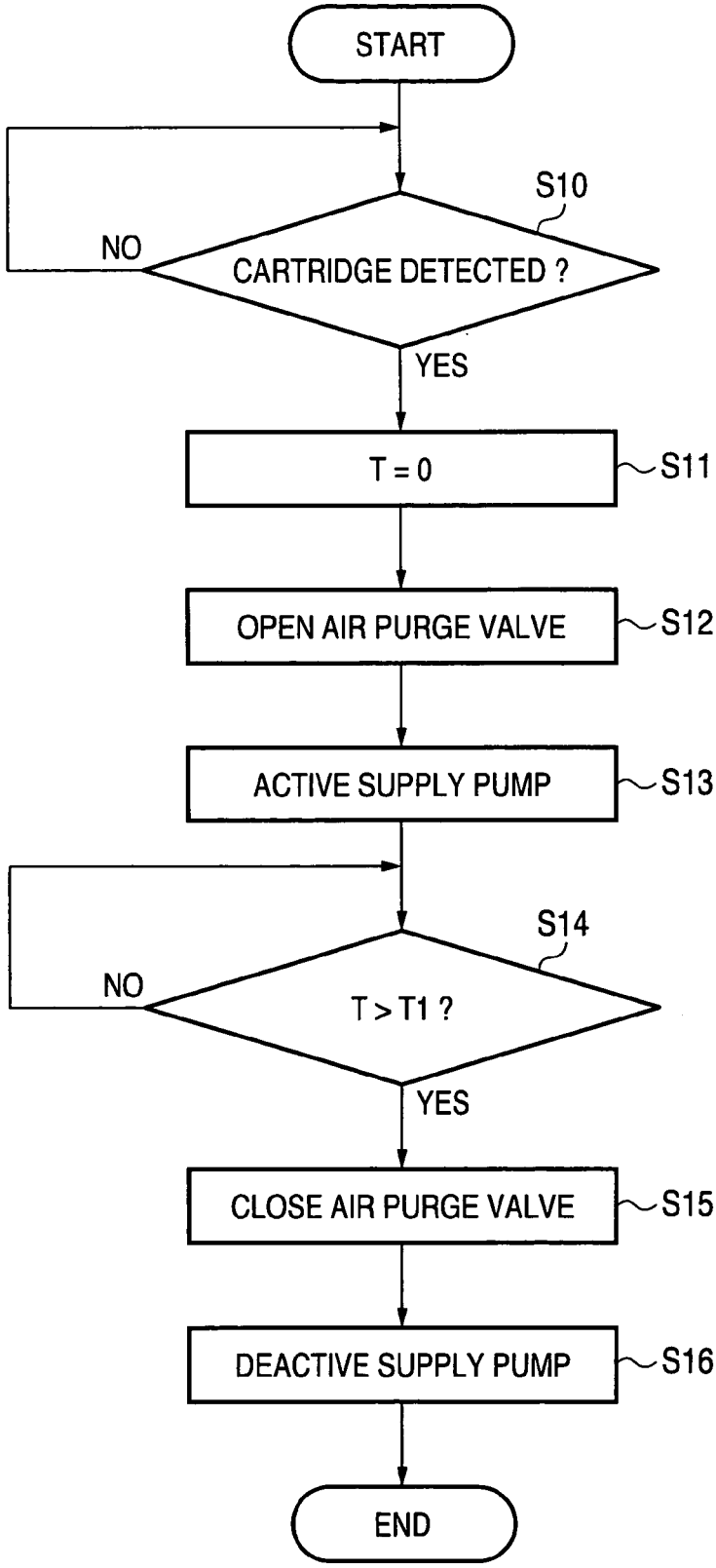
FIG. 13 is a flowchart of the purging operation.

Next, the purging operation to be performed at the time of loading of the ink cartridge 121 will be described in more detail by reference to the flowchart shown in FIG. 13. Si (i=10, 11, . . . ) denotes steps in the explanations provided below.

Under the situation where the inkjet printer 101 is newly used or the ink cartridge 121 is replaced with a new ink cartridge, when the ink cartridge 121 is loaded in the predetermined cartridge loading position provided on the inkjet printer 101, the cartridge detection section 122 detects loading of the ink cartridge 121 (Yes in S10), the controller 120 outputs, to the purge control sections 72*a* of the respective head control sections 72, a signal for commencing a purging operation.

When the purging operation is started as a result of the purge control section 72*a* having received the purging operation start signal, a timer T is set (S11). Subsequently, the air purging valve 78 is opened, whereupon the air purging passage 67 is released (S12). The supply pump 76 is then started, to thus supply ink from the ink supply port 3*a* into the ink supply passage 65 (S13). Then, when the time during which ink is supplied from the ink supply port 3*a* has exceeded a predetermined time T1 (Yes in S14), the purge control section 72*a* terminates the purging operation. Specifically, the air purging valve 78 is closed, so that the air purging passage 67 is closed (S15). The supply pump 76 is then stopped, to thus terminate supply of ink from the ink supply port 3*a* (S16). Here, the time T1 during which a purging operation is performed is determined from the volume of the ink supply flow passage 65 and that of the air purging passage 67 and from the discharging quantity of the supply pump 76, at the time of completion of the purging operation, such that the ink supplied from the ink supply port 3*a* after the point of commencement of the purging operation fills at least the ink supply flow passage 65 and the air purging passage 67. Therefore, the ink or air remaining in at least the ink supply passage 65 and the air purging passage 67 before a purging operation is completely replaced with the ink supplied after commencement of the purging operation when the purging operation has been completed after lapse of the time T1. Hence, the air in the ink supply flow passage 65 can be purged without fail.

According to the above-described inkjet printer 101 of the first embodiment, the air purging passage 67 is branched off from an area of the ink supply flow passage 65 located downstream of the filter 66. Specifically, the air purging passage 67 is branched at a position upstream of the individual ink flow passages 32 branched off from the manifold 5 for the individual pressure chambers 10. Hence, the majority of air in the ink supply flow passage 65 flows to the air purging flow passage 67 along with ink, thereby facilitating purging of air from the inside of the ink supply flow passage 65.

The meshes of the filter 66 which filtrate ink are set so as to become sufficiently smaller than the nozzle diameter, to thus form a structure which makes air easy to remain. The air purging passage 67 having small flow passage resistance is branched off from a position between the filter 66 and the manifold 5, thereby ensuring a large quantity of ink flowing through the filter 66. For this reason, a pressure difference sufficient to cause the air to pass through the filter 66 can be induced, and hence the air can be purged reliably from the inside of the flow passage without inducing remaining of air, which would otherwise be caused by the filter 66. When compared with a case where the air is purged from the plurality of individual ink flow passages 32 corresponding to the respective pressure chambers 10 (nozzles 8), only small ink supply pressure is required, thereby miniaturizing the supply pump 76. Moreover, the air of bubbles having passed through the fine meshes can be purged from a position upstream of the manifold 5. Hence, the air remaining in the vicinity of the filter 66 can be purged without fail. This can prevent, to the extent possible, occurrence of a drop in the ink ejection characteristics of the nozzles 8, which would otherwise be cause when air of minute bubbles flows into the individual ink flow passages 32, each having a small flow passage area, and adheres to the interior walls of the pressure chambers 10 or those of the nozzles 8.

The air purging valve 78 that can open and close the air purging passage 67 is released at the time of commencement of the purging operation. Hence, the air in the ink supply flow passage 65 can be readily purged to the outside by way of the purging passage 67. Moreover, the air purging valve 78 is closed at the time of completion of the purging operation. Hence, purging of excessive air from the air purging passage 67 can be prevented. Since the air purging passage 67 is opened/closed at an appropriate timing, the number of purging operations required to completely purge air can be reduced.

In the first embodiment, the detection signal output from the cartridge detection section 122 is input to the controller, and the controller 120 determines commencement of the purging operation. However, the detection signal may be input directly to the purge control section 72*a* of the control section 72, and the head control section 72 may determine commencement of the purging operation.

In the first embodiment, the purging operation is performed at the time of loading of the ink cartridge 121. However, the purging operation may be performed when a user has operated a purge start button or the like provided on a control panel of the inkjet printer 101. Alternatively, the purging operation may be performed on the basis of frequency of usage of the inkjet printer 101 determined from the number of sheets of paper to be printed or a period of time during which power is supplied to the inkjet printer 101. Moreover, the user may operate the air purging valve 78 directly, or the air purging valve 78 may be opened or closed when the user has operated the valve open/close button or the like provided on the control panel. The air purging valve 78 may be configured as a manual valve and opened or closed by user's manual operation.

There will now be described a second embodiment of the present invention. The second embodiment is different from the first embodiment in that the manifold 6 is branched off from the air purging passage at a position in the ink supply flow passage 65 extending from the ink supply port 3*a* to the manifold 5 by way of the ink reservoir 3*c*. In other respects, the second embodiment is the same as the first embodiment. In the following descriptions, the same reference numerals are assigned to elements having the same configurations as those described in connection with the first embodiment, and their explanations are omitted, to the extent appropriate.

Figure 14:
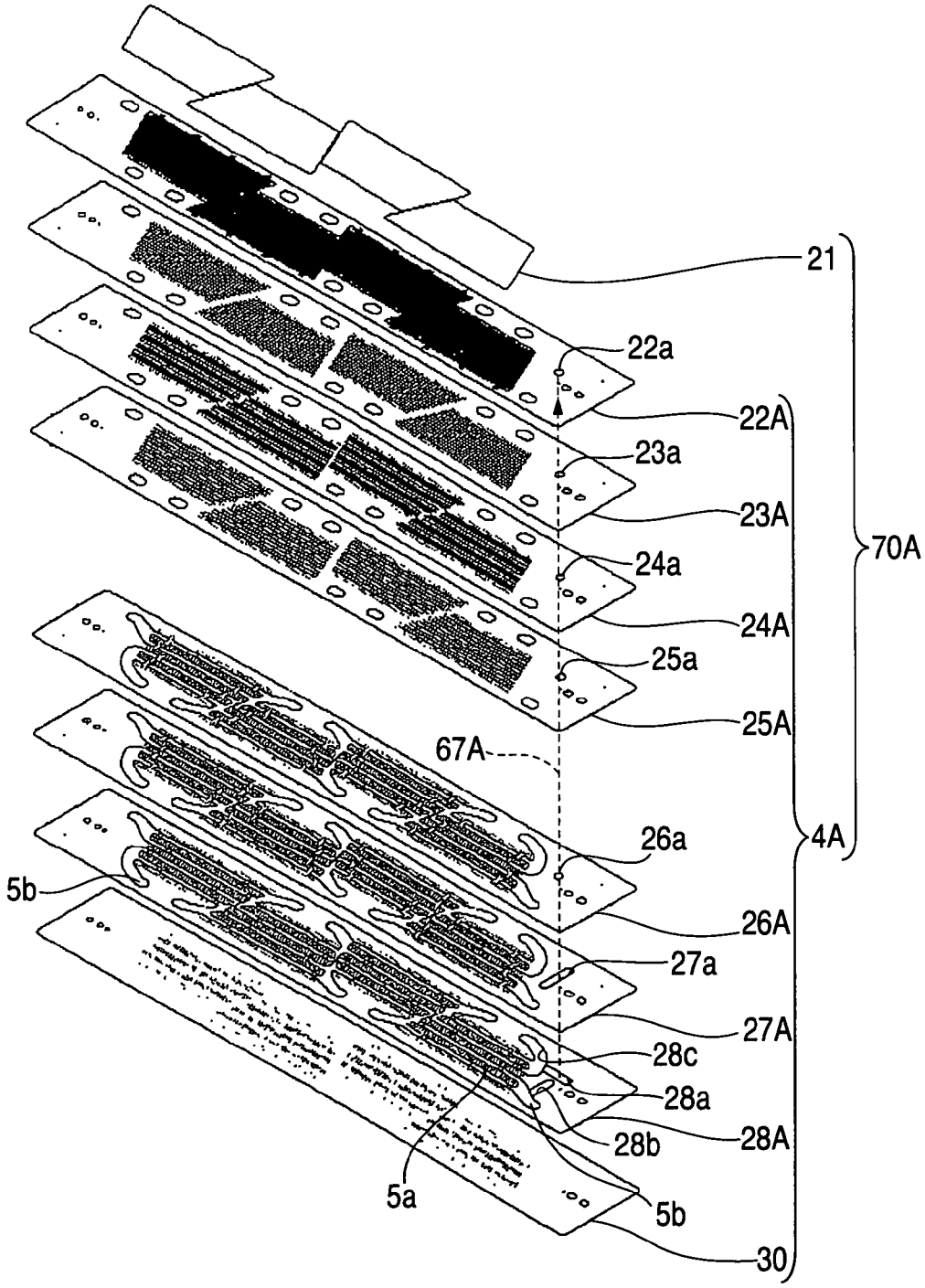
FIG. 14 is a fragmentary, exploded, perspective view of a head main body according to a second embodiment of the present invention.

As shown in FIG. 14, of three manifold plates 26A, 27A, and 28A in a flow passage unit 4A of a head main body 70A, a manifold formation hole 28*c* to be used for forming the manifold 5 is formed in the manifold plate 28A located at the lowest position. The manifold 5 comprises a plurality of sub-manifolds 5*a* for storing the ink supplied from the nozzles 8, and an ink inlet passage 5*b* for guiding the ink flowed from the ink outflow passage 3*d* of the reservoir unit 71 to the sub-manifolds 5*a*. There are formed two elongated holes 28*a*, 28*b* which are in communication with a manifold formation hole 28*c* and which extend in longitudinal and widthwise directions of the plate. The elongated holes 28*a*, 28*b* are branched off from a location of the manifold formation hole 28*c* where there is formed a flow passage extending to the sub-manifolds 5*a* from the two ink inlet passages 5*b* located at the end of the manifold formation hole in the main scanning direction (i.e., the right end in FIG. 14).

An elongated hole 27*a* extending in the widthwise direction of the plate is formed in a manifold plate 27A located above the manifold plate 28A. Both ends of the elongated hole 27*a* are formed so as to overlap the elongated holes 28*a*, 28*b* of the manifold plate 28A when viewed from the above. A hole 26*a* is formed at a position on a manifold plate 26A located above the manifold plate 27A where the position overlaps the elongated hole 27*a* of the manifold plate 27A when viewed from the above. A hole 25*a* is formed at a position on a supply plate 25A located above the manifold plate 27A where the hole overlaps the elongated hole 27*a* of the manifold plate 27A when viewed from the above. A hole 24*a* is formed at a position on an aperture plate 24A located above the manifold plate 27A where the hole overlaps the elongated hole 27*a* of the manifold plate 27A when viewed from the above. A hole 23*a* is formed at a position on a base plate 23A located above the manifold plate 27A where the hole overlaps the elongated hole 27*a* of the manifold plate 27A when viewed from the above. A hole 22*a* is formed at a position on a cavity plate 22A located above the manifold plate 27A where the hole overlaps the elongated hole 27*a* of the manifold plate 27A when viewed from the above.

Figure 15:
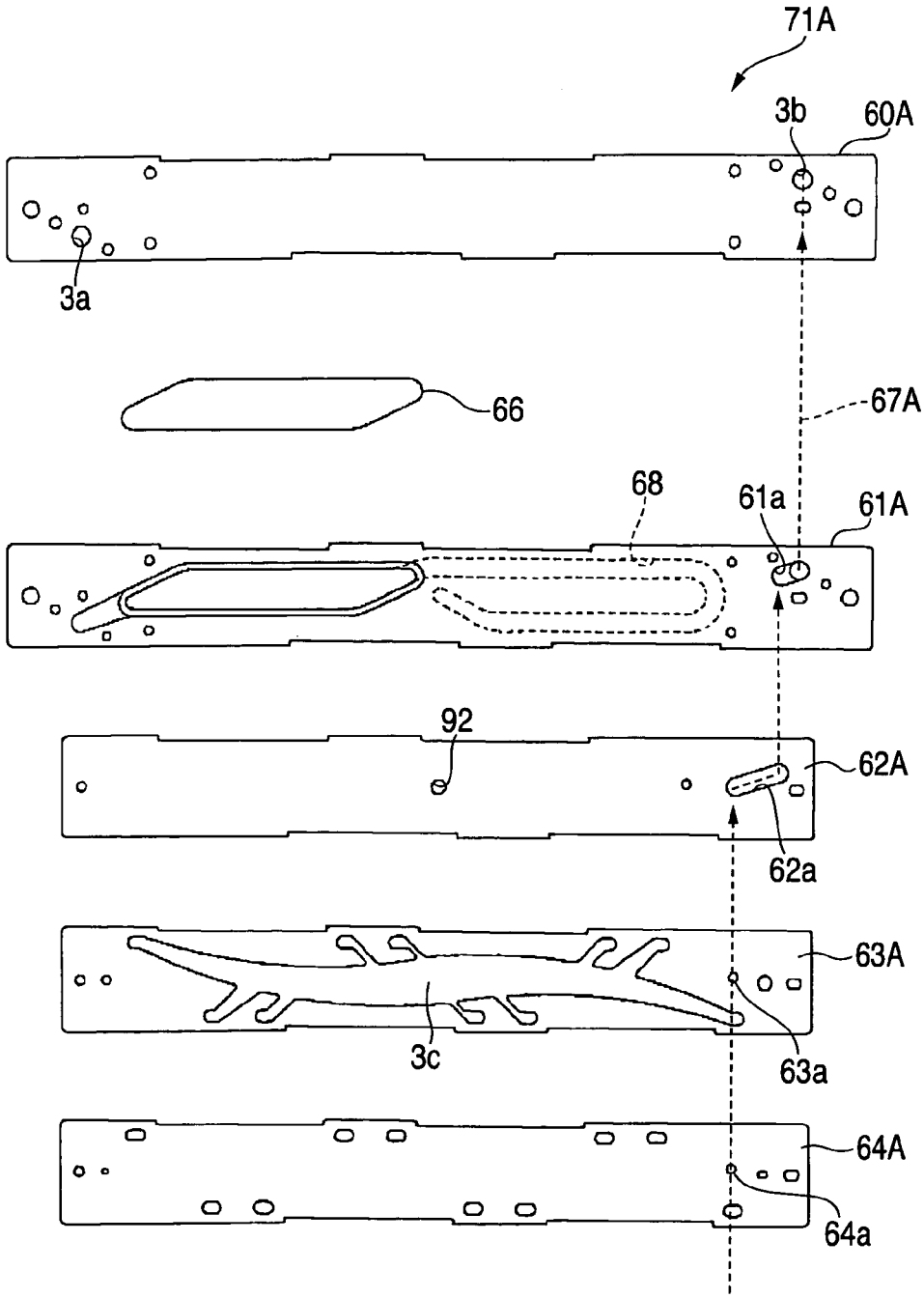
FIG. 15 is a plan view of respective plates constituting a reservoir unit of the second embodiment.

As shown in FIG. 15, a hole 64*a* is formed at a position on a fifth reservoir plate 64A of the reservoir plate unit 71A where the hole overlaps the hole 22*a* of the flow passage unit 4A when viewed from the above. A hole 63*a* is formed at a position on a fourth reservoir plate 64A of the reservoir plate unit 71A where the hole overlaps the hole 22*a* of the flow passage unit 4A when viewed from the above. An elongated hole 62*a* is formed in a third reservoir plate 62A located above the fourth reservoir plate 63A, and one end of the elongated hole 62*a* overlaps the hole 63*a* of the fourth reservoir plate 63A when viewed from the above. Moreover, a hole 61*a* is formed in a second reservoir plate located above the fourth reservoir plate when viewed from the above, wherein the hole 61*a* overlaps the elongated hole 62*a* of the third reservoir plate 62A and is in communication with the air purging port 3*b* formed in the first reservoir plate.

Accordingly, an air purging flow passage 67A is branched off from the ink inlet passage 5*b* of the manifold 5 and reaches the air purging port 3*b* by way of, in this sequence from the blew, the elongated holes 28*a*, 28, the elongated hole 27*a*, the holes 26*a*, 25*a*, 24*a*, 23*a*, 22*a*, all being provided in the flow passage unit 4A, and the holes 64*a*, 63*a*, and the elongated holes 62*a*, 61*a*, all being provided in the reservoir unit 71A. This air purging passage 67A is branched off from the manifold 5 located in the vicinity of the nozzles 8. Hence, bubble-like air having passed through the filter 66 can be prevented from flowing into the pressure chambers 10 and the nozzles 8 from the manifold 5.

The elongated holes 28*a*, 28*b* of the manifold plate 28A forming a branch section where the air purging passage 67A is branched off from the manifold 5 are branched from the flow passages extending from the two ink inlet passages 5*b* of the manifold 5 to the sub-manifolds 5*a*. Therefore, air can be purged by way of the area that is situated immediately before the location where the manifold 5 is branched into the sub-manifolds 5*a* and has a comparatively large flow passage area. Thus, air can be purged readily. In the meantime, inflow of air into the pressure chambers 10 and the nozzles 8 can be prevented without fail.

In the second embodiment, the air purging passages 67A is branched from two locations along the way from the opening section 5*b* of the manifold 5 to the sub-manifolds 5*a*. However, the number of branches is not limited to two. Further, the air purging passage may be branched off from the plurality of respective sub-manifolds 5*a* branched from the manifold 5.

There will now be described a third embodiment of the present invention. The third embodiment is different from the second embodiment in that an air purging flow passage 67B is provided. In other respects, the second embodiment is the same as the second embodiment.

In the following descriptions, the same reference numerals are assigned to elements having the same configurations as those described in connection with the second embodiment, and their explanations are omitted, to the extent appropriate.

Figure 16:
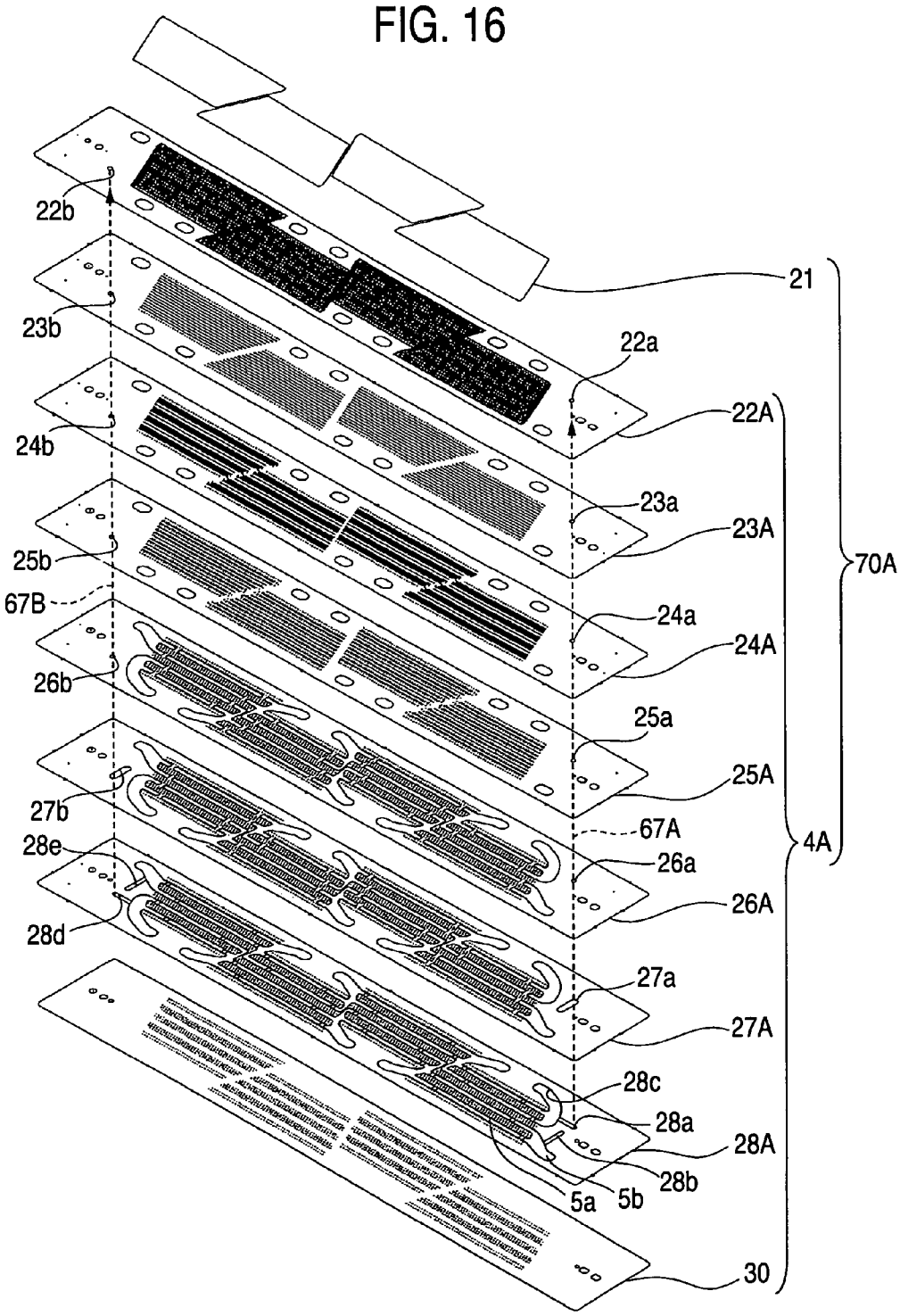
FIG. 16 is a fragmentary, exploded, perspective view of a head main body according to a third embodiment of the present invention.

As shown in FIG. 16, there are formed two elongated holes 28*d*, 28*e* which are in communication with a manifold formation hole 28*c* and which extend in longitudinal and widthwise directions of the plate.

The elongated holes 28*d*, 28*e* are branched off from a location of the manifold formation hole 28*c* where there is formed a flow passage extending to the sub-manifolds 5*a* from the two ink inlet passages 5*b* located at the end of the manifold formation hole in the main scanning direction (i.e., the left end in FIG. 16).

An elongated hole 27*b* extending in the widthwise direction of the plate is formed in a manifold plate 27A located above the manifold plate 28A.

Both ends of the elongated hole 27*b* are formed so as to overlap the elongated holes 28*e*, 28*d* of the manifold plate 28A when viewed from the above. A hole 26*b* is formed at a position on a manifold plate 26A located above the manifold plate 27A where the position overlaps the elongated hole 27*b* of the manifold plate 27A when viewed from the above. A hole 25*b* is formed at a position on a supply plate 25A located above the manifold plate 27A where the hole overlaps the elongated hole 27*b* of the manifold plate 27A when viewed from the above. A hole 24*b* is formed at a position on an aperture plate 24A located above the manifold plate 27A where the hole overlaps the elongated hole 27*b* of the manifold plate 27A when viewed from the above. A hole 23*b* is formed at a position on a base plate 23A located above the manifold plate 27A where the hole overlaps the elongated hole 27*b* of the manifold plate 27A when viewed from the above. A hole 22*b* is formed at a position on a cavity plate 22A located above the manifold plate 27A where the hole overlaps the elongated hole 27*b* of the manifold plate 27A when viewed from the above.

Figure 17:
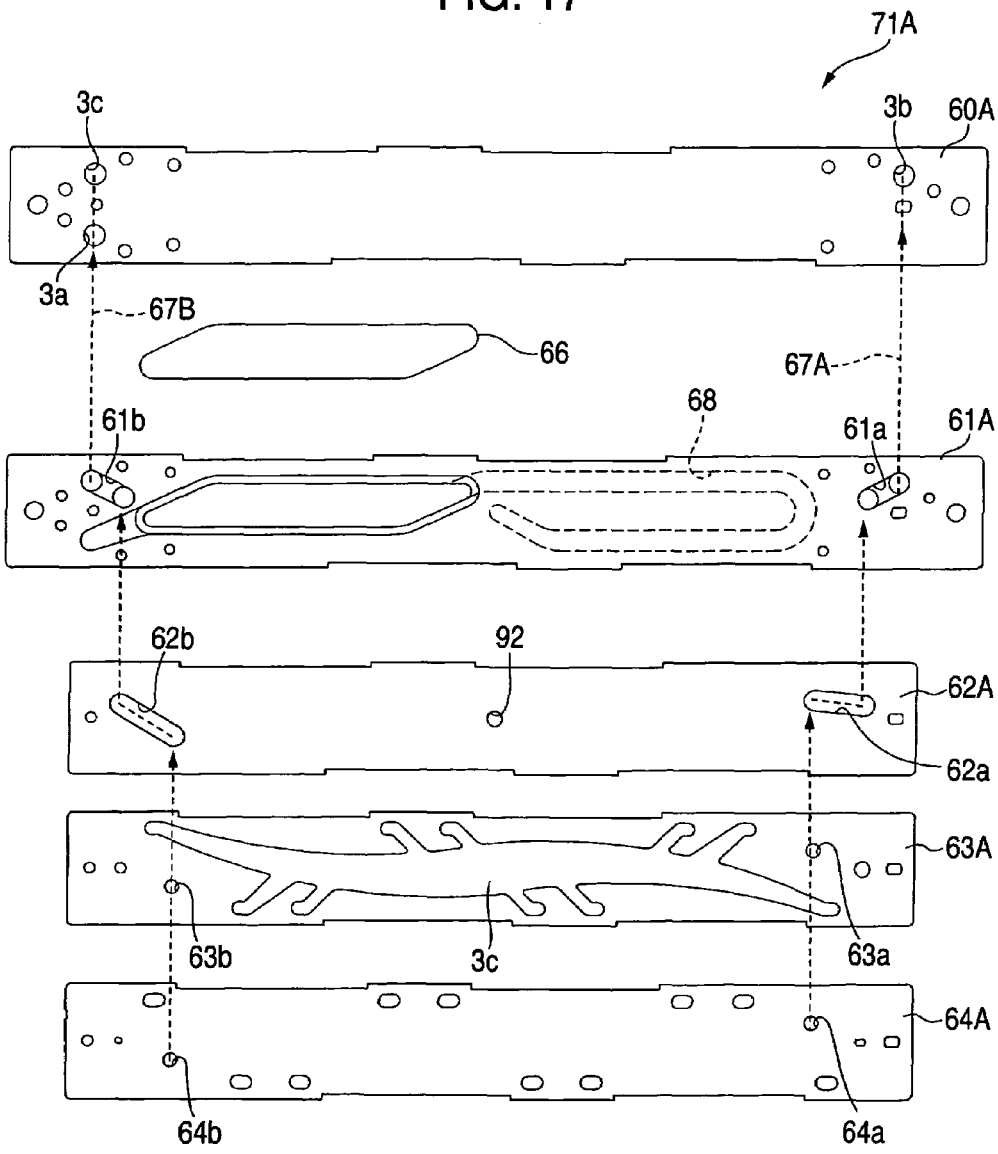
FIG. 17 is a plan view of respective plates constituting a reservoir unit of the third embodiment.

As shown in FIG. 17, a hole 64*b* is formed at a position on a fifth reservoir plate 64A of the reservoir plate unit 71A where the hole overlaps the hole 22*b* of the flow passage unit 4A when viewed from the above. A hole 63*b* is formed at a position on a fourth reservoir plate 64A of the reservoir plate unit 71A where the hole overlaps the hole 22*b* of the flow passage unit 4A when viewed from the above. An elongated hole 62*b* is formed in a third reservoir plate 62A located above the fourth reservoir plate 63A, and one end of the elongated hole 62*b* overlaps the hole 63*b* of the fourth reservoir plate 63A when viewed from the above. Moreover, a hole 61*b* is formed in a second reservoir plate located above the fourth reservoir plate when viewed from the above, wherein the hole 61*b* overlaps the elongated hole 62*b* of the third reservoir plate 62A and is in communication with the air purging port 3*c* formed in the first reservoir plate.

Accordingly, an air purging flow passage 67B is branched off from the ink inlet passage 5*b* of the manifold 5 and reaches the air purging port 3*c* by way of, in this sequence from the blew, the elongated holes 28*d*, 28*e*, the elongated hole 27*b*, the holes 26*b*, 25*b*, 24*b*, 23*b*, 22*b*, all being provided in the flow passage unit 4A, and the holes 64*b*, 63*b*, and the elongated holes 62*b*, 61*b*, all being provided in the reservoir unit 71A. This air purging passage 67B is branched off from the manifold 5 located in the vicinity of the nozzles 8. Hence, bubble-like air having passed through the filter 66 can be prevented from flowing into the pressure chambers 10 and the nozzles 8 from the manifold 5.

The elongated holes 28*e*, 28*d* of the manifold plate 28A forming a branch section where the air purging passage 67B is branched off from the manifold 5 are branched from the flow passages extending from the two ink inlet passages 5*b* of the manifold 5 to the sub-manifolds 5*a*. Therefore, air can be purged by way of the area that is situated immediately before the location where the manifold 5 is branched into the sub-manifolds 5*a* and has a comparatively large flow passage area. Thus, air can be purged readily. In the meantime, inflow of air into the pressure chambers 10 and the nozzles 8 can be prevented without fail.

In the third embodiment, the air purging passages 67B is branched from two locations along the way from the opening section 5*b* of the manifold 5 to the sub-manifolds 5*a*. However, the number of branches is not limited to four. Further, the air purging passage may be branched off from the plurality of respective sub-manifolds 5*a* branched from the manifold 5.

What is claimed is:

1. An inkjet printer comprising:

a flow passage unit including:

a common ink chamber extending in one plane; and a plurality of individual ink flow passages extending from said common ink chamber to nozzles by way of a pressure chamber;

a reservoir unit fixed to said flow passage unit, the reservoir unit including:

an ink supply port by way of which ink is supplied from outside; and an ink reservoir that stores said ink supplied by way of said ink supply port;

an ink supply flow passage extending from said ink supply port to said common ink chamber by way of said ink reservoir;

an air purging passage branching off from said ink supply flow passage;

an air discharge valve capable of opening and closing said air purging passage; and a valve open/close device that opens said air discharge valve when a purging operation starts to purge air from inside of said ink supply flow passage while ink is being supplied from said ink supply port to said ink supply flow passage and closes said air discharge valve when said purging operation has been completed.

2. The inkjet printer according to claim 1, wherein ink supplied by way of said ink supply port after commencement of said purging operation is filled in at least an ink supply flow passage and an air purging passage at the time of completion of said purging operation.

3. The inkjet printer according to claim 1, wherein said air purging passage branches off from an ink inlet passage that introduces ink into said common ink chamber.

4. The inkjet printer according to claim 1, wherein said air purging passage extends from a position where said air purging passage branches off from said ink supply port, upward toward an air outlet for discharging air to the outside.

5. The inkjet printer according to claim 1, wherein, in a state where said air purging passage is released, flow passage resistance of said air purging passage is lower than a total of flow passage resistance of a portion of said ink supply flow passage located downstream of said position where said air purging passage branches off from said ink supply flow passage and flow passage resistance of said individual ink flow passages.

6. An inkjet printer comprising:

a flow passage unit including:

a common ink chamber extending in one plane; and a plurality of individual ink flow passages extending from said common ink chamber to nozzles by way of a pressure chamber;

a reservoir unit fixed to said flow passage unit, the reservoir unit including:

an ink supply port by way of which ink is supplied from outside; and an ink reservoir that stores said ink supplied by way of said ink supply port;

an ink supply flow passage extending from said ink supply port to said common ink chamber by way of said ink reservoir;

an air purging passage branching off from said ink supply flow passage;

an air discharge valve capable of opening and closing said air purging passage;

a valve open/close device that opens said air discharge valve when air starts to purge from inside of said ink supply flow passage while ink is being supplied from said ink supply port to said ink supply flow passage and closes said air discharge valve when said purging operation has been completed; and a cartridge detection device that detects whether or not an ink cartridge is set at a predetermined loading position, wherein said purging operation is commenced when loading of a new ink cartridge is detected by said cartridge detection device.

7. An inkjet printer comprising:

a flow passage unit including:

a common ink chamber extending in one plane; and a plurality of individual ink flow passages extending from said common ink chamber to nozzles by way of a pressure chamber;

a reservoir unit fixed to said flow passage unit, the reservoir unit including:

an ink supply port by way of which ink is supplied from outside; and an ink reservoir that stores said ink supplied by way of said ink supply port;

an ink supply flow passage extending from said ink supply port to said common ink chamber by way of said ink reservoir;

an air purging passage branching off from said ink supply flow passage; and an air discharge valve capable of opening and closing said air purging passage;

wherein:

a filter that permits passage of ink is disposed at a position upstream of said ink supply flow passage, and said air purging passage branches off from a portion of said ink supply flow passage downstream of said filter.

8. The inkjet printer according to claim 7, wherein said air purging passage branches off from an area of said ink supply flow passage upstream of said ink reservoir.

9. The inkjet printer according to claim 8, wherein said ink supply flow passage has an ink drop flow passage extending from said ink supply port in an essentially U-shaped form within said single plane and reaching an ink drop port of said ink reservoir, and said air purging passage branches off from a U-shaped extremity of said ink drop flow passage.

* * * * *